US006676458B2

(12) United States Patent
Kuwayama et al.

(10) Patent No.: US 6,676,458 B2
(45) Date of Patent: Jan. 13, 2004

(54) STRUCTURE AND METHOD FOR CONNECTING TERMINAL AND ELECTRIC WIRE

(75) Inventors: Yasumichi Kuwayama, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/956,800

(22) Filed: Sep. 21, 2001

(65) Prior Publication Data

US 2002/0034898 A1 Mar. 21, 2002

(30) Foreign Application Priority Data

Sep. 21, 2000 (JP) ..... 2000-286954
Oct. 18, 2000 (JP) ..... 2000-317982
Aug. 27, 2001 (JP) ..... 2001-256720

(51) Int. Cl.[7] ..... H01R 4/10
(52) U.S. Cl. ..... 439/877; 439/431; 439/880
(58) Field of Search ..... 439/421, 870, 439/877, 878, 879, 880

(56) References Cited

U.S. PATENT DOCUMENTS 3,512,123 A * 5/1970 Costello et al. ..... 439/730
3,717,839 A 2/1973 Aldridge
4,214,121 A 7/1980 Charneski et al.
5,302,146 A * 4/1994 Yamamoto ..... 439/865
5,385,492 A * 1/1995 Stuart ..... 439/682
5,422,438 A * 6/1995 Lamome ..... 174/76
5,496,968 A * 3/1996 Katoh et al. ..... 174/19
5,499,448 A 3/1996 Tournier et al.
5,533,914 A * 7/1996 Sawada ..... 439/843
5,561,267 A * 10/1996 Fudoo et al. ..... 174/84 C
5,772,454 A * 6/1998 Long, Jr. ..... 439/83

FOREIGN PATENT DOCUMENTS

DE 198 14 474 C1 7/1999
JP 50-43746 12/1975 ..... H01R/43/04

* cited by examiner

*Primary Examiner*—P. Austin Bradley
*Assistant Examiner*—Edwin A. León
(74) *Attorney, Agent, or Firm*—Sughrue Mion, PLLC

(57) ABSTRACT

A tubular wire connecting portion (5), into which a core wire portion (3) of an electric wire (2) is insertable, is formed on a terminal (1). A core wire engagement portion (7) is formed in a circumferential wall of the wire connecting portion (5) to intersect with an internal surface of the circumferential wall. The wire connecting portion (5) is crimped around a full outer circumference thereof in a state in which the core wire portion (3) of the electric wire (2) is inserted into the wire connecting portion (5), whereby the core wire portion (5) at least partially enters an interior of the core wire engagement portion (7) and is engaged with the core wire engagement portion (7). The wire connecting portion (5) may be crimped in a radial direction of the electric wire (2) and uniformly compressed around a full outer circumference thereof.

6 Claims, 15 Drawing Sheets

STRUCTURE AND METHOD FOR CONNECTING TERMINAL AND ELECTRIC WIRE

BACKGROUND OF THE INVENTION

1. Field of the Invention

The present invention relates to a structure and method for connecting a terminal and an electric wire, in which a wire connecting portion of the terminal can uniformly be press-connected to a core wire portion of the electric wire, reliable electric contact of the connected portion thereof is obtained, and an interlocking force thereof is improved.

The present application is based on Japanese Patent Applications Nos. 2000-286954, 2000-317982 and 2001-256720, which are incorporated herein by reference.

2. Description of the Related Art

According to a mode of a structure for connecting an electric wire to a terminal, as shown in FIG. 1, a core wire portion 45 at a peeled terminal end of an electric wire 44 is clamped by a pair of crimping pieces 42 which are provided on both sides of a bottom plate portion of a terminal 41 in such a manner as to erect therefrom for fixed press attachment, so that a contact between the core wire portion 45 and the crimping pieces 42 is obtained.

The terminal 41 has a circular plate-like electric contact portion 46 at one end, the pair of core wire crimping pieces 42 as an wire connecting portion at the other end thereof and a pair of coating crimping pieces 43 provided rearward of the pair of the core wire crimping pieces. The coating crimping pieces 43 are press attached fixedly to an insulating resin coating of the electric wire 44, whereby the core wire portion 45 is prevented from being dislocated from the core wire crimping pieces 42.

According to a crimping method shown in FIG. 2, the pair of crimping pieces 42 are crimped in a eyeglasses-like manner between an upper crimper 47 and a lower anvil 48 and respective strands of the core wire portion 45 are compressed between the pair of crimping pieces 42 and a bottom plate portion 49.

However, while the connecting structure using the aforesaid solderless or crimping terminal 41 is effective for electric wires 44 of small diameters, for the electric wires of large diameters such as shield electric wires for conducting large current the connecting structure causes a problem that the contact area between the crimping pieces 42 and the core wire portion 45 becomes smaller, increasing electric resistance. In addition, since the crimping pieces 42 are strongly bent from the bottom plate portion 49 in the vicinity of where the crimper 47 is in contact with the anvil 48, the connecting structure also causes a problem that stress concentrates in bent portions, and the mechanical strength of the terminal 41 is lowered depending upon ways in which the crimping pieces 42 are bent.

To cope with this, there has been used a terminal 51 of a type in which a core wire connecting portion is crimped circumferentially at equal intervals, as shown in FIG. 3. This terminal 51 has a cylindrical electric contact portion 52 at one end and a cylindrical wire connecting portion 53 at the other end thereof, and the wire connecting portion 53 is crimped circumferentially at equal intervals into, for example, a hexagonal shape with a peeled core wire portion at a terminal end of an electric wire 54 being inserted into the wire connecting portion 53. A coated portion 55 of the electric wire 44 is located rearward of the wire connecting portion 53 with a gap being provided therebetween. A mating male connector (not shown) is connected to the electric contact portion 52 located on the front side of the terminal 51 by inserting or screwing the former into the latter.

An embodiment of a connecting method (a connecting structure) of this type for connecting the terminal 51 and the electric wire 44 has been recited in Examined Japanese Utility Model Publication No. Sho. 50-43746, and will be described below with reference to FIG.

In this connecting method, an wire connecting portion 62, initially formed into a cylindrical shape, is crimped into a hexagonal shape with a pair of upper and lower die halves 63 with a core wire portion 61 of the electric wire being inserted into the cylindrical wire connecting portion of the terminal so that the core wire portion 61 is caused to adhere to the wire connecting portion 62 from inside as well as to each other. In each die half 63, as shown in FIG. 5, there are formed three pressing surfaces 64, and an elongate projection 65 is formed on each pressing surface 64. As shown in FIG. 4, the elongate projections 65 press against central portions of external surfaces of the hexagonal wire connecting portion 62, respectively, in radial directions so that the contact qualities of the core wire portion 61 of the electric wire and the wire connecting portion 62 of the terminal are improved.

However, in the aforesaid connecting method and a connecting structure using the same method, as shown in FIG. 4, burrs 60 tend to be generated on both sides of the wire connecting portion between the upper and lower die halves 63, and this causes a problem that many man-hours are disadvantageously required to remove the burrs 60 so generated. More over, when the wire connecting portion 62 of the terminal is crimped with the pair of upper and lower die halves 63, as shown in FIG. 6, a crimping force (internal stress) P1 directed toward the center of the core wire portion 61 tends to act largely, whereas crimping forces (internal stresses) P2 applied to both sides of the core wire portion 61 tend to be reduced, and this tends to cause a problem that gaps are produced between strands of the core wire portion 61, as well as between the core wire portion 61 and the wire connecting portion 62 on both the sides of the wire connecting portion 62 of the terminal. In case such gaps are produced, electric resistance is increased, and energizing efficiency is reduced. Moreover, there is caused a concern that the connecting portion is heated.

In addition, in a case where aluminum material is used for the core wire portion 61, since an oxidized coating on the surface of the core wire portion 61 is thick, the coating needs to be broken, but the oxidized coating cannot be completely removed when the core wire portion 61 is clamped by the pair of crimping pieces 42 for connection or when the cylindrical wire connecting portion 53 is crimped into the hexagonal shape for connection, whereby there is also caused a problem that the electric resistance is increased, and the reliable electric connection is damaged.

In addition, FIG. 7 shows the result of crimping an electric wire for connection using a similar method to that illustrated in FIG. 4. Since elongate projections 65 formed on die halves 63 press against a core wire portion 61' at six positions thereon in radial directions as indicated by arrows F, the core wire portion 61' is deformed into a turtle-like shape in cross section, and stress concentration (chain lines 79 indicate an internal stress distribution) occurs in an wire connecting portion 62' of a terminal between respective recessed portions 77 produced by the respective elongate projections 65 (FIG. 5), or at raised portions 78, whereby the core wire portion 61' cannot be circumferentially uniformly crimped. This helps form easily gaps 70 in the interior of the core wire portion 61' (gaps between respective strands), as well as gaps 70 between the core wire portion 61' and the wire connecting portion 62' of the terminal, and cracks are also easily generated in the wire connecting portion 62' due to the stress concentration. Thus, there is caused a problem that the mechanical strength of the wire connecting portion is deteriorated. In case there are formed gaps 70, 71, as with the previous case, electric resistance is increased, thereby decreasing energizing efficiency. In addition, there are caused concerns that the wire connecting portion 62' is heated and that the core wire portion 61' is easily dislocated from the wire connecting portion 62'.

Furthermore, in the structure for connecting the terminal 51 and the electric wire 54 shown in FIG. 3, since the respective strands of the core wire portion of the electric wire 54 line contact the inner circumferential surface of the wire connecting portion 53 of the terminal 51 in the longitudinal direction, the mechanical strength is weak against crimping, and therefore, in case a strong tensile force acts on, for example, the electric wire 54 or the terminal 51, there is caused a concern that the core wire portion tends to be dislocated from the wire connecting portion 53.

SUMMARY OF THE INVENTION

The present invention was made in view of the aforesaid situations, and an object thereof is to provide a structure for connecting a terminal and an electric wire which can ensure, of course, that the core wire portion of the electric wire and the wire connecting portion of the terminal, as well as the respective strands of the core wire portion are brought into contact without any gap being produced therebetween, additionally, that even if the core wire portion is used which has the thick oxidized coating resulting when the aluminum material is used, the core wire portion is brought into contact with the wire connecting portion of the terminal with low electric resistance, and moreover, that even in case the strong tensile force acts on the electric wire or the terminal, the core wire portion is not dislocated from the wire connecting portion.

Further, another object thereof is to provide a method and structure for connecting a terminal with an electric wire in which the cylindrical wire connecting portion of the terminal can be circumferentially uniformly crimped around the electric wire such that there is caused no scattering of internal stress and beautifully such that there is caused no burrs, whereby there is caused no gap between the strands in the core wire portion of the electric wire and between the core wire portion and the wire connecting portion of the terminal, thereby improving the reliability in electrically connecting the electric wire with the terminal and improving the mechanical strength of the wire connecting portion of the terminal.

To achieve the above objects, according to a first aspect of the present invention, there is provided a structure for connecting a terminal and an electric wire. The structure comprises a tubular wire connecting portion, into which a core wire portion of an electric wire is insertable, formed on a terminal, and a core wire engagement portion formed in a circumferential wall of the wire connecting portion, the core wire engagement portion intersecting with an internal surface of the circumferential wall, wherein the wire connecting portion is crimped around a full outer circumference thereof in a state in which the core wire portion of the electric wire is inserted into the wire connecting portion, whereby the core wire portion at least partially enters an interior of the core wire engagement portion and is engaged with the core wire engagement portion.

According to a second aspect of the present invention, it is effective that the core wire engagement portion includes a hole portion formed through the circumferential wall of the wire connecting portion, or a groove portion.

According to a third aspect of the present invention, it is also effective that a plurality of the core wire engagement portions are disposed circumferentially in the wire connecting portion.

According to a fourth aspect of the present invention, it is also effective that an intersecting portion, at which the core wire engagement portion intersects with the internal surface of the circumferential wall, is formed into an edge.

According to a fifth aspect of the present invention, there is provided a structure for connecting a terminal and an electric wire. The structure comprises a tubular wire connecting portion, into which a core wire portion of an electric wire is insertable, formed on a terminal, and a plurality of irregularities formed on an internal circumferential surface of the wire connecting portion of the terminal, wherein the wire connecting portion is crimped around a full outer circumference thereof in a state in which the core wire portion of the electric wire is inserted into the wire connecting portion, whereby the irregularities bite into the core wire portion of the electric wire.

According to a sixth aspect of the present invention, it is effective that the irregularities include at least one spiral groove and a plurality of thread portions.

According to a seventh aspect of the present invention, it is also effective that the core wire portion of the electric wire is twisted, and wherein a spiral direction of the irregularities is opposite to a twisting direction of the core wire portion of the electric wire.

According to an eighth aspect of the present invention, it is also effective that the irregularities include groove portions and thread portions, and wherein the groove portions and thread portions intersect with each other.

According to a ninth aspect of the present invention, there is provided a method for connecting a terminal to an electric wire. The method comprises the steps of:

- providing a terminal including a tubular wire connecting portion;
- inserting a core wire portion of an electric wire into the wire connecting portion of the terminal;
- crimping the wire connecting portion in a radial direction of the electric wire; and
- uniformly compressing the wire connecting portion around a full outer circumference thereof in the radial direction of the electric wire.

According to a tenth aspect of the present invention, it is effective that, in the uniformly compressing step, while a die is rotated using a rotary swaging device, the wire connecting portion of the terminal is compressed with the die.

According to an eleventh aspect of the present invention, it is effective that the method of the tenth aspect further comprises forming a projecting portion on an outer circumference of the wire connecting portion, wherein, in the uniformly compressing step, the projecting portion is pressed, thereby causing an inner surface of the wire connecting portion to partially inwardly project so as to bite into the core wire portion.

According to a twelfth aspect of the present invention, there is provided a structure for connecting a terminal to an electric wire. The structure comprises a tubular wire connecting portion, into which a core wire portion of an electric wire is insertable, formed on a terminal, the wire connecting portion being crimped in a radial direction of the electric wire, wherein the wire connecting portion is uniformly compressed along a full outer circumference thereof in the radial direction of the electric wire, whereby a circumference of a compressed portion of the wire connecting portion is formed into a round shape in cross section.

According to a thirteenth aspect of the present invention, it is preferable that the structure of the twelfth aspect further comprises a projecting portion formed on an outer circumference of the wire connecting portion before the wire connecting portion is crimped, wherein the projecting portion is pressed when the wire connecting portion is uniformly compressed, thereby causing an inner surface of the wire connecting portion to partially inwardly project so as to bite into the core wire portion.

According to a fourteenth aspect of the present invention, the projecting portion may include a circumferentially elongated projection or at least one projection.

BRIEF DESCRIPTION OF THE DRAWINGS

The above and other objects and advantages of the present invention will become more apparent by describing in detail preferred embodiments thereof with reference to the accompanying drawings, wherein:

FIGS. 8A to 8C are perspective views showing a first embodiment of a structure for connecting a terminal and an electric wire according to the present invention, in which FIG. 8A shows a state before connection is implemented, whereas FIG. 8B shows a state after the connection is implemented, and FIG. 8C shows a groove portion (recessed portion) instead of a hole portion shown in FIGS. 8A and 8B;

DETAILED DESCRIPTION OF THE PREFERRED EMBODIMENTS

Preferred embodiments according to the present invention now will be described hereinbelow with reference to FIGS. 8A to 30.

FIGS. 8A to 10 show a first embodiment of a structure for connecting a terminal and an electric wire according to the present invention.

Figure 8A:
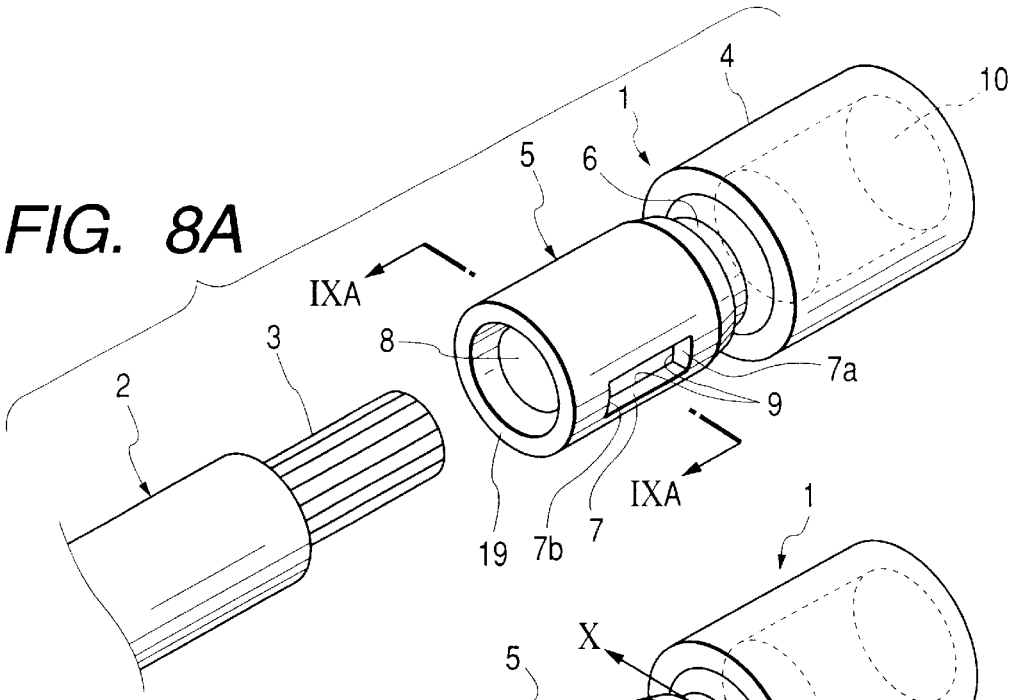
Figure 8B:
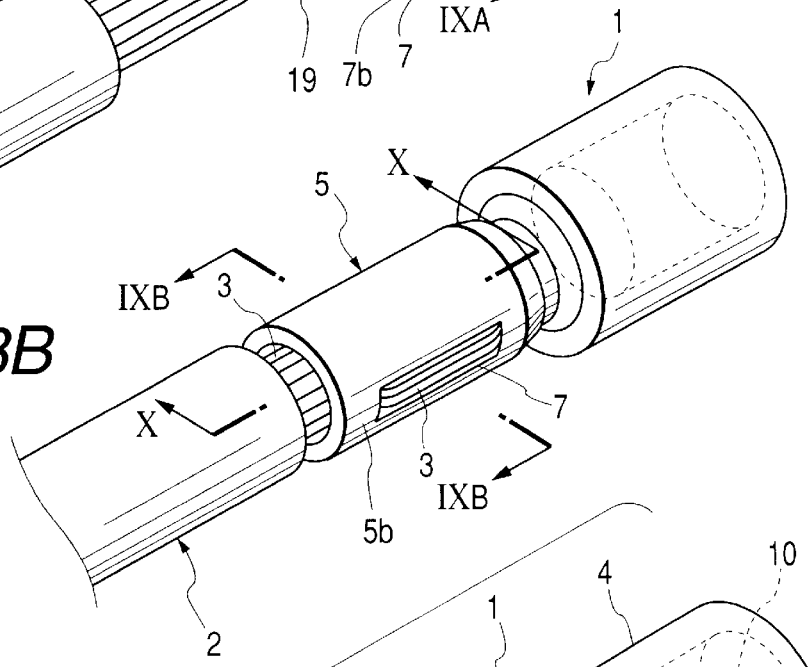

FIG. 8A shows a state in which a core wire portion 3, which is a conductor portion of an electric wire 2, is inserted into a terminal 1 made of conductive metal. The terminal 1 has a cylindrical mating connecting portion 4 at one end and an electric connecting portion 5, which is a cylindrical sleeve, on the other end thereof, and both the connecting portions are connected to each other via a short cylindrical partition wall portion 6 of a small diameter.

In the wire connecting portion 5, a plurality of rectangular slit-like hole portions (core wire engagement portions) 7 are formed in an annular circumferential wall 19. The circumferential wall 19 is contiguous with a bottom wall 28 (FIG. 10) on a partition wall portion 6 side. The slit-like hole portions 7 are formed straight in a longitudinal direction of the wire connecting portion 5 in such a manner that a front end 7*a* and a rear end 7*b* of the hole portion 7 are located in front of a front end and a rear end of the wire connecting portion 5, respectively.

The number of hole portions 7 may be three and they may disposed equally at 120 degrees intervals. Alternatively, there are provided four hole portions which are disposed equally at 90 degrees intervals. It is also possible to provide four or more hole portions 7, and they are not necessarily disposed at equal intervals. In addition, the hole portions 7 may be divided such that they are located before and after the wire connecting portion 5 or may be disposed in a zigzag fashion. There may be provided only one hole portion 7, but it is preferable from the viewpoint of removing an oxidized coating on the core wire portion that a plurality of hole portions 7 are provided as will be described later.

Figure 9A:
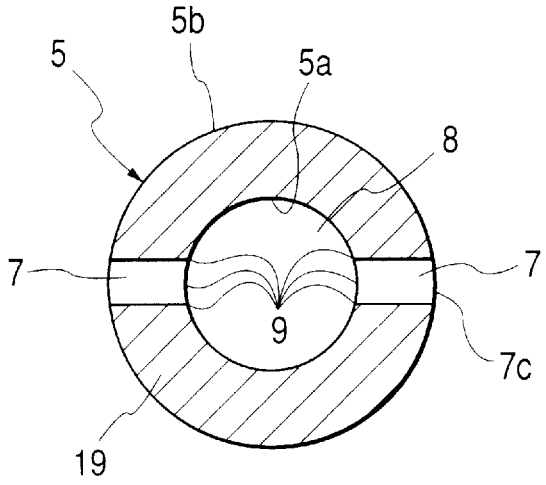
FIG. 9A is a cross-sectional view taken along the line IXA—IXA in FIG. 8A.

As shown in FIG. 9A, the hole portions 7 penetrate the cylindrical wire connecting portion 5 toward the center thereof in such a manner as to communicate with a core wire insertion hole 8 inside the wire connecting portion 5. In addition, the hole portions 7 intersect with an inner circumferential surface 5*a* and an outer circumferential surface 5*b* of the wire connecting portion 5 substantially at right angles, and in particular lines of intersection with the inner circumferential surface 5*a* of the hole portion 7 are made to be sharp edges 9. As shown in FIG. 8A, the edges 9 are formed longitudinally and transversely in such a manner as to correspond to the four sides of the rectangular slit-like hole portion 7.

A tapered guide surface (not shown) for guiding the core wire portion 3 is formed at the entrance of the core wire insertion hole 8 in the wire connecting portion 5. A mating terminal engagement hole 10 is formed inside the mating terminal connecting portion 4, and for example, a mating terminal (not shown) having a plurality of resilient contact pieces is inserted into the mating terminal engagement hole 10, whereby an electric wire or accessory (not shown) on the mating terminal side is connected with the electric wire 2 via a cylindrical female terminal 1.

Figure 9B:
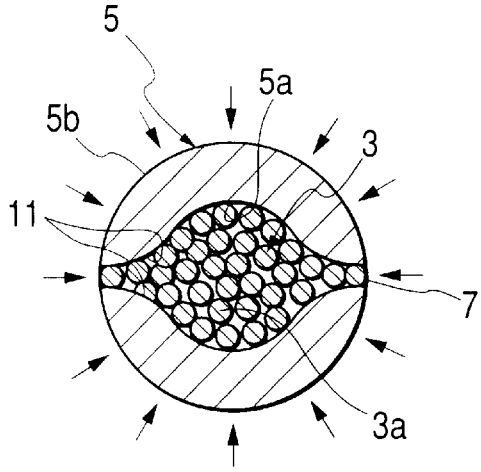
FIG. 9B is a cross-sectional view taken along the line IXB—IXB in FIG. 8B.
Figure 10:
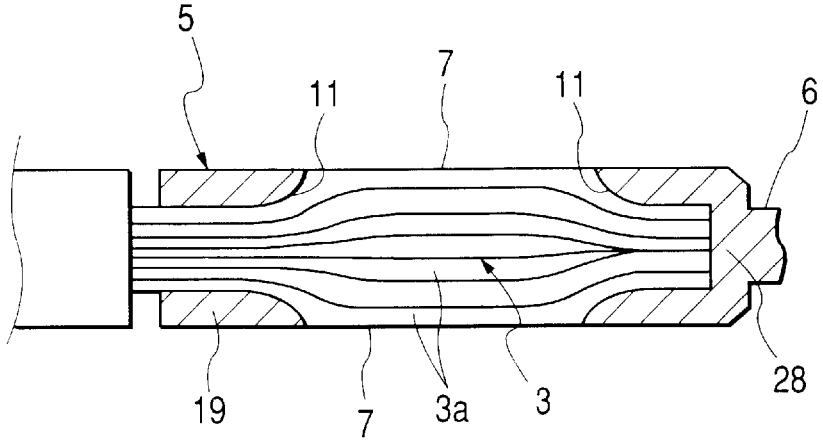
FIG. 10 is a cross-sectional view taken along the line X—X in FIG. 8B.

FIGS. 8A, 9B and 10 show a state in which the wire connecting portion 5 is equally (uniformly) crimped around the full circumference thereof in radial directions with the core portion 3 of the electric wire 2 being inserted into the wire connecting portion 5 of the terminal 1. Here, the expression of "around the full circumference" means that "without excluding any portions on the outer circumferential surface 5*b* of the circumferential wall 19 of the wire connecting portion 5."

The electric connecting portion 5 is circumferentially crimped with uniform force as shown in FIG. 9B by crimping the wire connecting portion 5 around the full circumference thereof, whereby the core wire portion 3 of the electric wire 2 is brought into press contact with the inner circumferential surface 5*a* of the wire connecting portion 5 around the full circumference thereof with the uniform force (FIG. 9B) to thereby ensure that the core wire portion 3 adheres to the inner circumferential surface 5*a* with no gap being produced therebetween, and respective strands 3*a* of the core wire portion 3 are also caused to adhere to each other with no gap being produced therebetween. Moreover, the oxidized coating on the surface of the core wire portion 3 is broken or scraped off by the edges 9 of the rectangular slit-like hole portions 7, whereby a conductive surf ace (a newly produced surface) of the core wire portion 3 is brought into contact with the wire connecting portion 5 with extremely low electric resistance. This is particularly effective when aluminum material or the like having a thick oxidized coating is used.

Removing the oxidized coating by the edges 9 is mainly implemented while the wire connecting portion 5 is being crimped, and as shown in FIGS. 9B and 10, when the crimping operation is completed, the edges 9 are curved into a radius, whereby it is ensured that the core wire portion 3 adheres to curved portions 11 with no gap being produced therebetween with no unreasonable magnitude of force being applied to the core wire portion 3 due to the curved portions 11, thereby making it possible to prevent the core wire portion 3 from being damaged or the respective strands 3*a* from being broken.

In addition, as shown in FIG. 9B, openings 7*c* (FIG. 9A) in the hole portions 7 become closer on the outer circumference than the inner circumference of the wire connecting portion 5, whereby the projection of the core wire portion 3 out of the hole portions 7 is prevented. Uniform internal stress directed to the center of the core wire portion 3 and outward repulsive force are caused to act on the core wire portion 3 around the full circumference thereof when the wire connecting portion 5 is crimped around the full circumference thereof. In addition, the contact area between the core wire portion 3 and the wire connecting portion 5 is increased when part of the core wire portion 3 enters the hole portions 7, whereby the electric resistance is reduced, the reliability in establishing an electric connection being thereby enhanced.

Figure 8C:
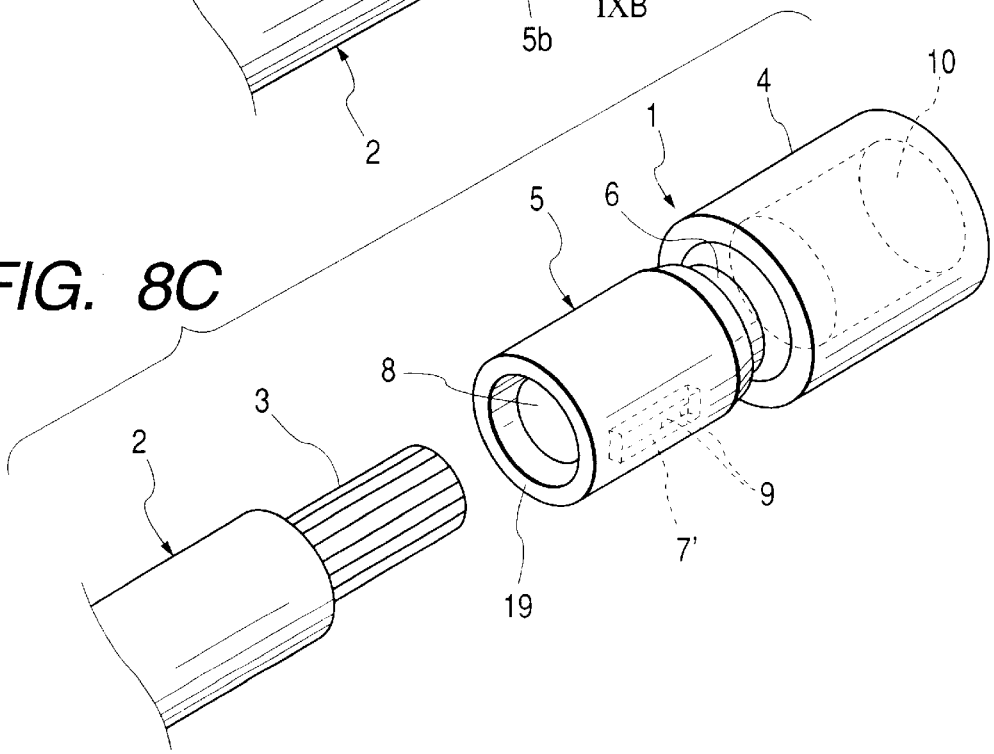

It should be noted that instead of slit-like hole portions 7 circular or oval hole portions (not shown) maybe formed as the core wire engagement portion. Alternatively, groove portions (recessed portions) 7' may be formed instead of the hole portions 7 as shown in FIG. 8C. Needless to say, the groove portions 7' are formed in the inner circumferential surface 5*a* of the wire connecting portion 5. As the number of hole portions 7 or groove portions 7' increases, the area of the oxidized coating of the core wire portion 3 that should be peeled off increases, and therefore the enhancement in electric performance can be expected.

In addition, the edges are not necessarily sharp but may be only sharp to such an extent that the oxidized coating on the surface of the core wire portion of the electric wire is broken or removed when the crimping operation is carried out.

Figure 11:
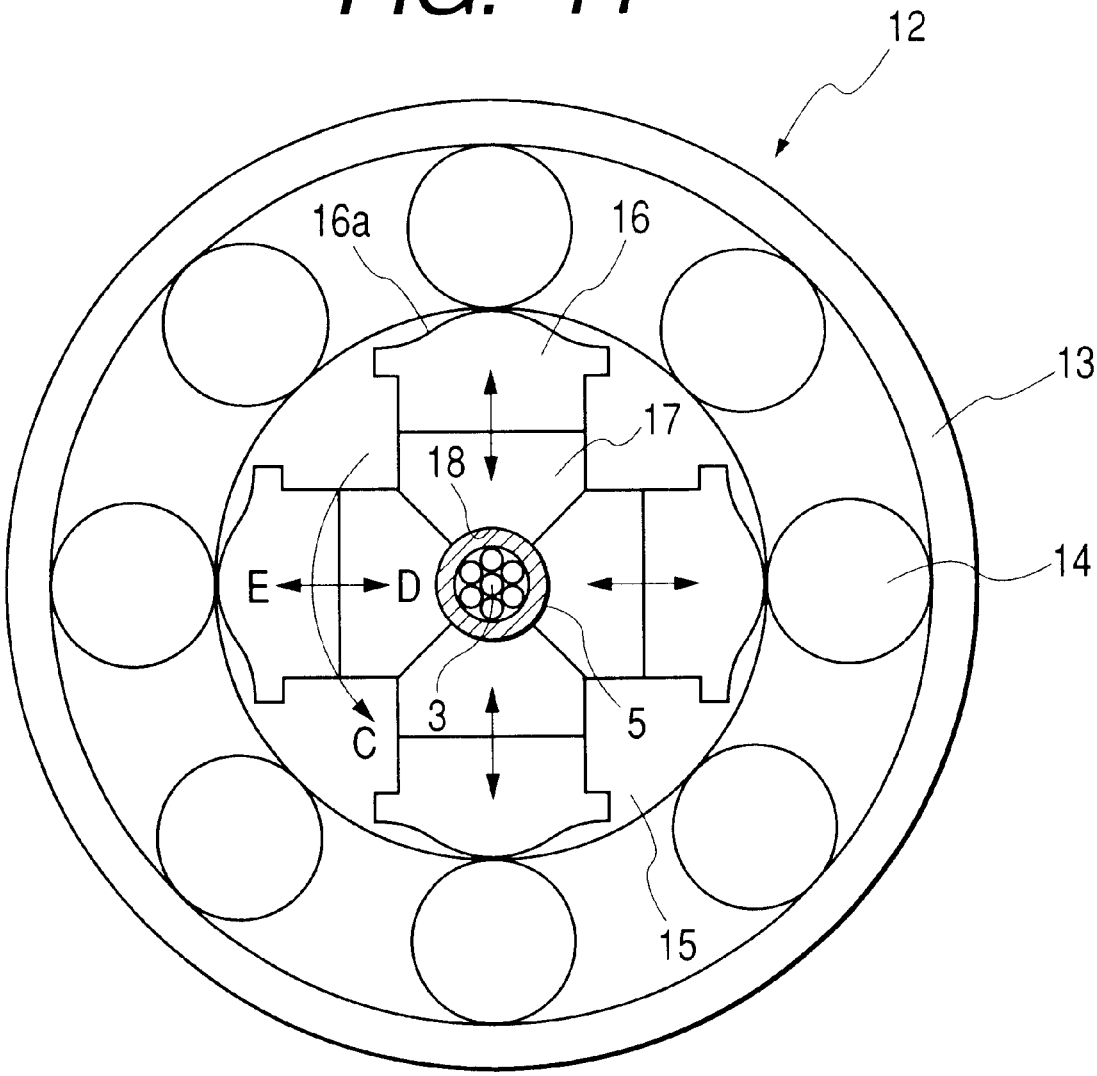
FIG. 11 is a front view showing a processing part of a rotary swaging device for use with a method for connecting a terminal and an electric wire according to the present invention.

FIG. 11 shows a processing part 12 of a rotary swaging device which is one of the so-called full circumference crimping devices.

The swage process (swaging) was introduced a long time ago and has been used since then in the field of plastic processing of metal. Originally, a hammer was used to strike metal work to plastically deform it, but the operation of striking the metal work with the hammer to plastically deform it has been rationalized mechanically and physically from standpoints of processing efficiency, processing accuracy, workability and safety.

In FIG. 11, reference numeral 5 denotes a cylindrical wire connecting portion of the terminal (see FIGS. 8A and 8B), reference numeral 3 a core wire portion of an electric wire, reference numeral 13 an outer ring, reference numeral 14 a rotatable roller, reference numeral 15 a spindle adapted to be driven to rotate, reference numeral 16 a bucker (a hammer) movable in radial directions, reference numeral 17 a die also movable in radial directions, respectively.

The spindle 15 is driven to rotate by a motor not shown. The die comprising four die pieces 17 is disposed at equal intervals and movable in radial directions of the electric wire. A hole portion 18 is provided at the center of the respective die pieces 17 for insertion of the wire connecting portion 5 of the terminal. The respective die pieces 17 can move together with the buckers 16, respectively, in the radial directions of the electric wire. An outer circumferential surface of the bucker 16 is formed into a cam surface 16*a*. The die pieces 17 and the buckers 16 rotate together with the spindle 15. The cam surfaces 16*a* of the buckers 16 are brought into contact with the outer circumference of the outer rollers 14, and the plurality of rollers 14 are disposed at equal intervals between the inner spindle 15 and the outer ring 13 in such a manner that the rollers 14 rotatably contact the cam surfaces 16*a* or the outer circumferential surface of the spindle 15 and the inner circumferential surface of the ring 13.

When the spindle 15 rotates by driving the motor (not shown), the die pieces 17 and the buckers 16 rotate together in a direction indicated by an arrow C, and the cam surfaces 16*a* of the buckers 16 are brought into slide contact with the outer circumference of the rollers 14. When top portions of the cam surfaces 16*a* come into contact with the rollers 14, the four die pieces 17 are closed as indicated by arrows D, whereas when the buckers 16 and the die pieces 17 are moved outwardly as indicated by arrows E by virtue of centrifugal force so that foot portions of the cam surfaces 16*a* come into contact with the rollers 14, the four die pieces 17 are opened. Thus, the four die pieces 17 are opened and closed while rotating.

When the die pieces 17 are closed, the wire connecting portion 5 of the terminal is struck with arc-like inner circumferential surfaces (also denoted by reference numeral 18) of the respective die pieces 17 to be compressed in the radial direction, whereas when the die pieces 17 are opened, a gap is produced between the inner circumferential surfaces 18 of the die pieces 17 and the outer circumferential surface of the wire connecting portion 5. The core wire portion 3 of the electric wire 2 is crimped into a substantially true round shape at the wire connecting portion 5 of the terminal by rotating, and opening and closing the die pieces repeatedly.

Since the wire connecting portion 5 is compressed in the radial direction while rotating the die pieces 17 relative to the terminal (see FIGS. 8A and 8B), no burr is produced at the wire connecting portion 5, whereby a good external appearance is imparted to the outer circumferential surface 5*b* of the wire connecting portion 5, and at the same time the wire connecting portion 5 is circumferentially uniformly crimped so that internal stresses in the core wire connecting portion 3 and the wire connecting portion become uniform, thereby no gap being produced between the respective strands 3*a* of the core wire portion 3, as well as between the core wire portion 3 and the wire connecting portion 5.

Note that the numbers of die pieces 17 and buckers 16 provided are not necessarily four but may be two, and in a case where two die pieces 17 and two buckers 16 are used, the die pieces 17 are disposed in a symmetrical fashion at 180 degrees interval. In addition, the means for crimping the wire connecting portion 5 of the terminal 1 uniformly around the full circumference thereof is not limited to the rotary swaging device but other processing devices (not shown) may be used.

In the rotary swage process, for example, an electric wire 2 having a cross-sectional area of about 20 mm and a terminal of a plate thickness of about 2.2 mm are used, but by modifying the die pieces 17, the structure of the present invention can deal with an electric wire having a cross-sectional area of about 0.3 $mm^2$ and a terminal of a plate thickness of about 0.25 mm.

FIGS. 12 to 15 show a second embodiment of a structure for connecting a terminal and an electric wire according to the present invention.

Figure 12:
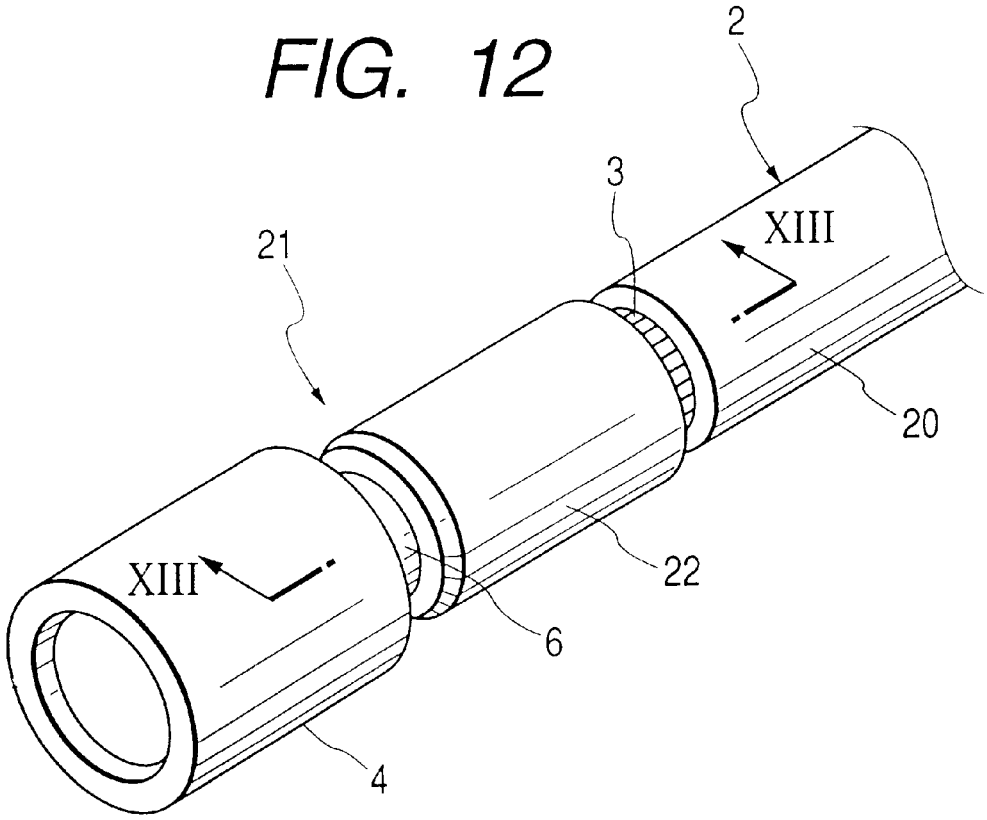
FIG. 12 is a perspective view showing a second embodiment of a structure for connecting a terminal and an electric wire according to the present invention.
Figure 14:
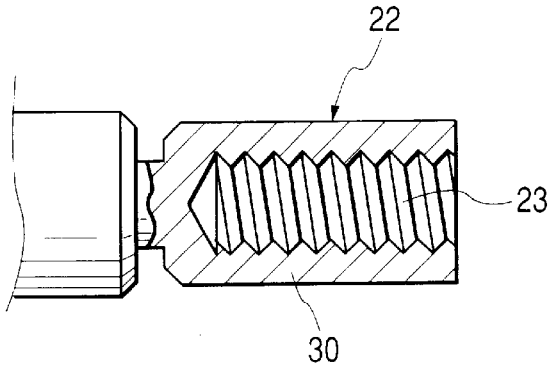
FIG. 14 is a cross-sectional view showing the configuration of irregularities on an inner circumferential surface of an wire connecting portion of the terminal.
Figure 15:
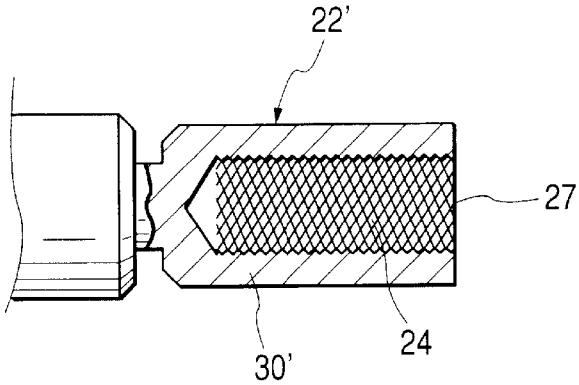
FIG. 15 is a cross-sectional view showing the configuration of irregularities according to another embodiment formed on the inner circumferential surface of the wire connecting portion of the terminal.

FIG. 12 shows an external view of the structure in which a cylindrical wire connecting portion 22 of a terminal 21 is crimped around the full circumference thereof with the cylindrical wire connecting portion 22 receiving the core wire portion 3 of the electric wire 2. The slit-like hole portions 7 (see FIGS. 8A and 8B) used in the first embodiment are not formed, but instead, for example, internal threads 23 which are one mode of spiral irregularities as shown in FIGS. 13 and 14 or knurls 24 which are one mode of intersecting irregularities as shown in FIG. 15 are formed on the inner circumferential surface of the circumferential wall 30, 30' of the wire connecting portion 22, 22' with a view to enhancing the fixedly attaching force or adhering force between the core wire portion 3 and the wire connecting portion 22, 22'.

The internal threads 23 include thread portions 23*a* and groove portions 23*b* (root portions) which are a plurality of spiral irregularities, and the knurls 24 include a plurality of intersecting thread portions and groove portions (foot portions). The thread portions 23*a* and the groove portions 23*b* are disposed in an alternate fashion.

In FIG. 12, reference numeral 4 denotes a mating terminal connecting portion which is similar to that described with respect to the first embodiment, and reference numeral 6 a partition wall portion for connecting both the connecting portions 4, 22 together. A slight gap exists between a rear end of the wire connecting portion 22 and a front end of an insulating coating 20 of the electric wire 2.

Figure 13:
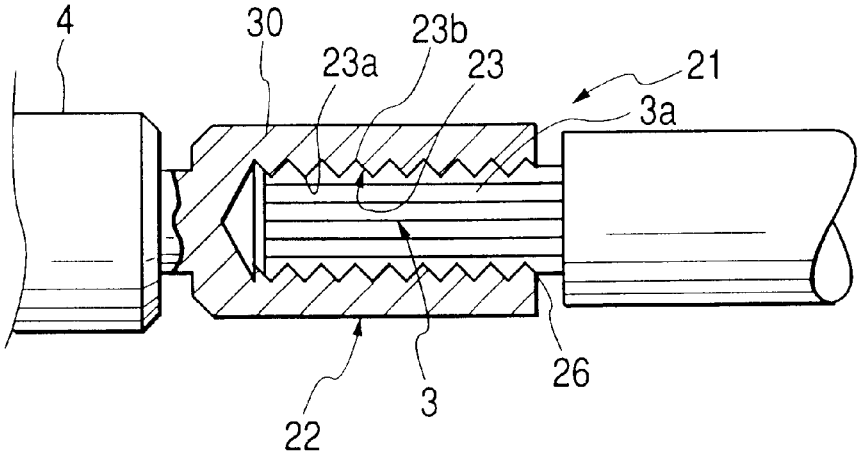
FIG. 13 is a cross-sectional view taken along the line XIII—XIII in FIG. 12.

In FIG. 13, the wire connecting portion 22 is crimped around the full circumference thereof, and the thread portions 23*a* of the internal threads 23 bite into respective strands on an outer circumference side of the core wire portion 3, whereby the strands are resiliently and plastically deformed in the radial direction. This allows the core wire portion 3 to strongly adhere to the inner circumferential surface of the wire connecting portion 22, whereby not only is the mechanical strength such as a tensile drag of the electric wire 2 and the terminal 21 enhanced but also oxidized coatings of the outer strands of the core wire portion 3 are broken or scraped off, ensuring that the core wire 3 connects with the wire connecting portion with low electric resistance.

Even in a case where aluminum material (aluminum alloy) is used for the core wire portion 3, the thick oxidized coating is broken by distal ends of the relatively sharp thread portions 23*a* of the internal threads 23, or when the full circumference crimping operation is carried out the wire connecting portion 22 extends in the longitudinal direction and the thick oxidized coating is scraped off with the distal ends of the thread portions 23*a* of the internal threads 23, whereby the electric contact qualities can be improved. The respective strands 3*a* deform to the configuration of the internal threads 23 so as to adhere to the thread portions 23*a* and the root portions 23*b* of the internal threads 23 with no gap being produced therebetween, whereby the contact area between the wire connecting portion 22 and the core wire portion 3, and this lowers electric resistance, the reliability in establishing an electric connection being thereby improved. The thread portions 23*a* of the internal threads 23 becomes slightly lower and gently as the wire connecting portion 22 extends in the longitudinal direction when the full circumferential crimping operation is implemented. In addition, although the distal ends of the thread portions 23*a* are relatively sharp, since being different from a blade portion, it is inclined in an angled fashion, there is no concern that the strands are cut.

It is preferable that the direction, in which the internal threads 23 are cut, is opposite to the direction in which the core wire portion 3 is twisted. For example, in a case where the respective strands 3*a* of the core wire portion is twisted rightward, a terminal is used in which leftward internal threads are formed, whereas in a case where the respective strands 3*a* of the core wire portion 3 are twisted leftward, rightward internal threads 23 are used. Either of the leftward and rightward internal threads 23 may be used for a core wire portion 3 having no twisted strands.

By forming internal threads 23 in such a manner as to intersect with the twisting direction of the core wire portion 3 the respective strands 3*a* and the thread portions 23*a* of the internal thread 23 are pressed to adhere to each other in a state in which they intersect with each other, whereby that the thread portions 23*a* bite into the respective strands 3*a* assuredly and strongly, the aforesaid advantage being thereby exhibited more remarkably. Of course, needless to say, even if the twisting direction of the core wire portion 3 and the threading direction of the internal threads 23 are identical to each other, the aforesaid advantage is equally exhibited. Threading can easily be performed through tapping. The aforesaid effectiveness can be exhibited sufficiently if threads are formed in the wire connecting portion on the entrance side thereof half the length of the electric wire insertion hole 26.

Note that it is also effective to form, instead of the internal threads 23, spiral relatively sharp thread portions or relatively sharp non-continuous concentric thread portions. While the internal threads 23 or spiral thread portions are constructed by forming spiral grooves having a triangular cross section in the inner circumferential surface of the electric wire insertion hole 26 of the wire connecting portion 22, the spiral grooves may be formed at a wide pitch or they may be formed intermittently.

The screen-like knurls 24 shown in FIG. 15 which replace the internal threads 23 can exhibit strong adhering force and fixedly attaching force irrespective of the twisting direction of the core wire portion 3. The knurls 24 are constructed by forming a plurality of inclined (screen-like) grooves in such a manner as to cross each other, and as with the internal threads 23, it is preferable that the knurls are formed at a small pitch in such a manner that thread portions thereof have relatively sharp distal ends. The knurls 24 can be formed easily by, for example, strongly pressing a cylindrical metallic tool (not shown) having crossed thread portions on the outer circumference thereof against the inner circumferential surface of a core wire insertion hole 27 of the circumferential wall 30' of the cylindrical wire connecting portion 22' while rotating the terminal or the metallic tool. FIG. 13 is regarded as showing a state in which the wire connecting portion 22' of the electric wire 2 in which the knurls 24 are formed is crimped around the full circumference of the core wire portion 3 of the electric wire 2.

When the wire connecting portion 22' is crimped around the full circumference thereof in a manner similar to that described with reference to FIG. 13 with the core wire portion 3 being inserted into the wire connecting portion 22' having the knurls 24 the thread portions of the knurls 24 break the oxidized coatings on the strands 3*a* of the core wire portion on the outer circumference side thereof, and newly produced surfaces of the core wire portion 3 adhere to the inner circumferential surface of the wire connecting portion 22'. In addition, when the thread portions of the knurls 24 bite into the strands 3*a* on the outer circumferential side of the core wire portion 3, whereby the retaining force between the core wire portion 3 and the wire connecting portion 22' is enhanced, the resistance to tensile force, that is, the mechanical strength being thereby increased. While these operations and effectiveness are similar to those provided by the internal threads 23, since the knurls cross each other, the core wire portion 3 contacts the wire connecting portion 22' at the number of thread portions double the numbers of internal threads 23 and spiral grooves, that is, over a wider contact area, whereby the electric resistance is lowered further and the fixedly attaching strength is increased double.

The area where the knurls 24 are formed may extend over the full length of the core wire insertion hole 27 in the wire connecting portion 22' or the knurls 24 may be formed over a length on the order of half the length of the core wire insertion hole 27 on the entrance side. The pitch between the respective thread portions of the crossed knurls 24 may be set wider.

Figure 16:
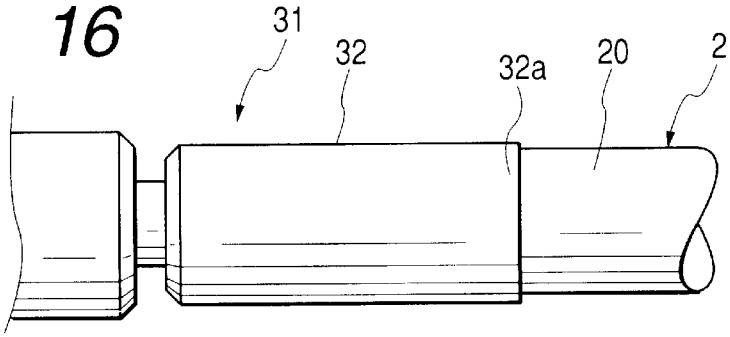
FIG. 16 is a perspective view showing a third embodiment of a structure for connecting a terminal and an electric wire according to the present invention.
Figure 17:
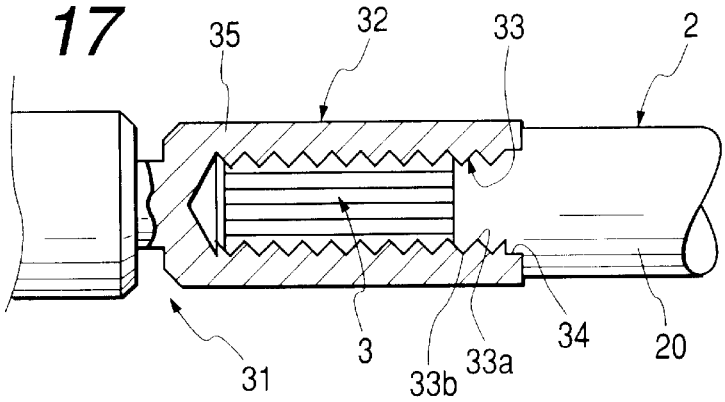
FIG. 17 is a cross-sectional view showing a state in which an electric wire is connected (joined) to a terminal.

FIGS. 16 and 17 show a third embodiment of a structure for connecting a terminal and an electric wire according to the present invention.

While as with the structure described in the second embodiment, in this structure a plurality of irregularities 33 such as the internal thread-like, spiral groove-like or knurl-like irregularities are formed in an inner circumferential surface of a cylindrical wire connecting portion 32 of a terminal, the wire connecting portion 32 is crimped around the full circumference thereof with an insulating coating 20 of the electric wire 2 being inserted together with the core wire portion 3 into an electric wire insertion hole 34 in the wire connecting portion (an electric wire joining portion) 32, so that the insulating coating 20 of the electric wire 2 is crimped around and fixed to the inside of the wire connecting portion 32 from inside together with the core wire portion. This construction is effective as a connecting method for connecting a terminal and an electric wire. The crimping process is implemented with for example the rotary swaging device used in the previous embodiments.

As shown in FIG. 16, the insulating coating 20 of the electric wire 2 made from synthetic resin or synthetic rubber is crimped at a distal end portion 32*a* of the cylindrical wire connecting portion 32, whereby the inner circumferential surface of the wire connecting portion 32 and the outer circumferential surface of the insulating coating 20 are caused to adhere to each other with no gap being produced therebetween.

As shown in FIG. 17, the plurality of spiral or intersecting irregularities 33 are formed around the full circumference of the inner circumference of the insertion hole 34 in the wire connecting portion 32, and a short annular circumferential portion (denoted also by reference numeral 34) and irregularities 33 continuous with the circumferential portion are formed in the wire connecting portion 32 on the entrance side thereof. The irregularities include groove portions 33*b* (bottom portions) and thread portions 33*a*.

The insulating coating 20 of the electric wire 2 is pressed in a radial direction toward the center of the electric wire by the plurality of thread portions 33*a* of the irregularities, and is compressed around the full circumference thereof, whereby the flexible or elastic insulating coating 20 is rigidly fixed so that the coating 20 is not dislocated from the wire connecting portion 32. This increases the resistance to tensile strength or resistance to torsional strength, that is, the fixedly attaching force, whereby the core wire portion 3 is made further difficult to be dislocated from the wire connecting portion 32, and the core wire portion 3 is sealed within the wire connecting portion 32, whereby the waterproofness of the connecting portion between the electric wire 2 and the terminal 31 is enhanced, thereby preventing the penetration of water or dust into the core wire portion 3 and oxidization of the core wire portion.

The inside diameter of the wire connecting portion 32 relative to the insulating coating 20 may be made slightly larger than the inside diameter of a portion thereof which corresponds to the core wire portion 3. As with the second embodiment, it is ensured that the core wire portion 3 is brought into contact with the wire connecting portion 32 with low electric resistance when the irregularities 33 or the plurality of annular or spiral thread portions 33*a* having the relatively sharp distal ends formed on the inner circumferential surface of the wire connecting portion 32 break the oxidized coating on the core wire portion 3, and the resistance to tensile strength or resistance to torsional strength is enhanced. In this embodiment, since both the core wire portion 3 and the insulating coating 20 are crimped with the irregular surfaces of the wire connecting portion 32, the resistance to tensile strength or resistance to torsional strength is enhanced greater than the second embodiment.

It should be noted that the inner circumferential portion of the wire connecting portion 32 corresponding to the insulating coating 20 of the electric wire 2 may have a surface free from the irregularities 33, and the irregularity-free surface may be strongly pressed against to the insulating coating 20 so as to adhere thereto by crimping the wire connecting portion 32 around the full circumference thereof. Even in this case, needless to say, irregularities 33 are formed on the inner circumferential surface of the wire connecting portion 32 at a portion corresponding to the core wire portion 3.

In addition, in the respective embodiments, the wire connecting portions 5, 22, 32 of the terminals 1, 21, 31 may be formed into a polygonal shape instead of the perfect cylindrical shape, in particular, the outer circumferential surface of the wire connecting portion 5, 22, 32 is formed into a polygonal shape (it is preferable to have as many angles as possible, in other words, it is preferable to have a polygon close to a circle as much as possible), such that when crimped around the full circumference thereof the angles are collapsed to such an extent that the polygon is formed into a substantially circular shape or a perfect circular shape. Even in this case, the outer circumferential surface of the wire connecting portion 5, 22, 32 needs to be crimped around the full circumference thereof in the radial direction of the electric wire with no portion being left crimped.

The respective structures for connecting a terminal and an electric wire is effective as an invention of a single terminal or a connecting method for connecting a terminal and an electric wire.

As has been described heretofore, according to the embodiments of the present invention, the outer portion of the core wire portion of the electric wire enters the core wire engagement portions for engagement therewith by crimping the wire connecting portion of the terminal around the full circumference thereof in the radial direction, and as this occurs the oxidized coating on the surface of the core wire portion is broken by the circumferential edges on the inner side of the core wire engagement portions or the portions where the inner surfaces of the circumferential wall and the core wire engagement portions or scraped off when the plastic deformation occurs due to the crimping operation, whereby it is ensured that the newly produced surface is brought into contact with the wire connecting portion with low electric resistance. Even if a metallic material such as aluminum material which tends to have a thicker oxidized coating is used for the core wire portion, the aforesaid structure can provide assured and stable electric performance with low electric resistance. In addition, the core wire portion is fixed to the wire connecting portion of the terminal rigidly as the part of the core wire portion enters the core wire engagement portions for engagement therewith, and even if a strong tensile force is applied to the electric wire or the terminal, the core wire is prevented from being dislocated from the wire connecting portion, whereby the reliability in establishing an electric connection can be improved. Furthermore, the internal stress in the wire connecting portion directed radially centrally becomes uniform around the full circumference thereof, and as this occurs no gap is produced between the wire connecting portion and the core wire portion, as well as between the respective strands of the core wire portion, whereby, needless to say, the electric contact qualities can be improved.

In addition, according to the embodiment of the present invention, the hole portions acting as the core wire engagement portions can easily be formed through a punching operation using a die or a punch. Additionally, since the groove portions acting as the core wire engagement portions do not penetrate the wire connecting portion radially outwardly, the interior of the wire connecting portion is closed, whereby water is prevented from penetrating into the wire connecting portion, the oxidization of the core wire portion being thereby prevented.

Furthermore, according to the embodiments of the present invention, since the plurality of core wire engagements are disposed circumferentially, the contact area between the newly produced surface of the core wire portion and the wire connecting portion is expanded, the improvement in electric contact qualities and increase in fixing force for fixing the core wire portion to the wire connecting portion can be further enhanced.

Moreover, according to the embodiments of the present invention, it is ensured that the oxidized coating on the surface of the core wire portion is broken by the edges of the core wire engagement portions or is scraped off, whereby the improvement in electric contact qualities can be further enhanced when the metallic material whose oxidized coating tends to be thicker is used.

In addition, according to the embodiments of the present invention, since the plurality of irregularities formed inside the wire connecting portion bite into the core wire portion, the oxidized coating on the surface of the core wire portion is broken by the irregularities or is scraped off by the irregularities which are forced to move in association of deformation happening when crimping operation is implemented, whereby it is ensured that the newly produced surface of the core wire portion is brought into contact with the wire connecting portion with low electric resistance, the reliability in establishing an electric connection being thereby improved. At the same time, since the irregularities bite into the core wire portion, the fixedly attaching force for fixedly attaching the core wire portion to the wire connecting portion can be increased, and even if a strong tensile force is applied to the terminal or the electric wire, it is ensured that the dislocation of the core wire portion from the wire connecting portion is prevented, whereby the reliability in establishing an electric connection can be improved.

Furthermore, according to the embodiments of the present invention, since the internal threads are formed as the spiral groove portions and thread portions, the formation of irregularities can be implemented with ease and low costs. The plurality of spiral groove and thread portions acting as a plurality of irregularities bite uniformly into the core wire portion around the full circumference thereof to come into contact therewith, the electric contact qualities being thereby improved.

Moreover, according to the embodiments of the present invention, in a case where the core wire portion is twisted, since the internal threads are formed in the opposite direction to the twisting direction, the respective strands on the outer circumferential side of the core wire portion intersect with the thread portions so as to press against each other, whereby the core wire portion is brought into uniform and assured contact with the wire connecting portion, the reliability in establishing an electric connection being thereby improved.

In addition, according to the embodiments of the present invention, the stable electric contact can be obtained around the full circumference of the core wire portion by the intersecting thread and groove portions irrespective of the direction in which the core wire portion is twisted. In addition, with the pitch between the thread portions remaining the same as that between the spiral irregularities the newly produced surface of the core wire portion can provide the contact area double that provided by the intersecting thread and groove portions relative to the wire connecting portion, whereby a further stable electric contact can be obtained with lower electric resistance.

A fourth embodiment of the present invention now will be described with reference to FIGS. 18 to 26. In the fourth embodiment, a cylindrical wire connecting portion, in which a core wire portion (a conductor portion) of an electric wire is already inserted, is gradually compressed in radial directions with die halves rotating in a circumferential direction of the electric wire using a rotary swaging device.

Figure 18:
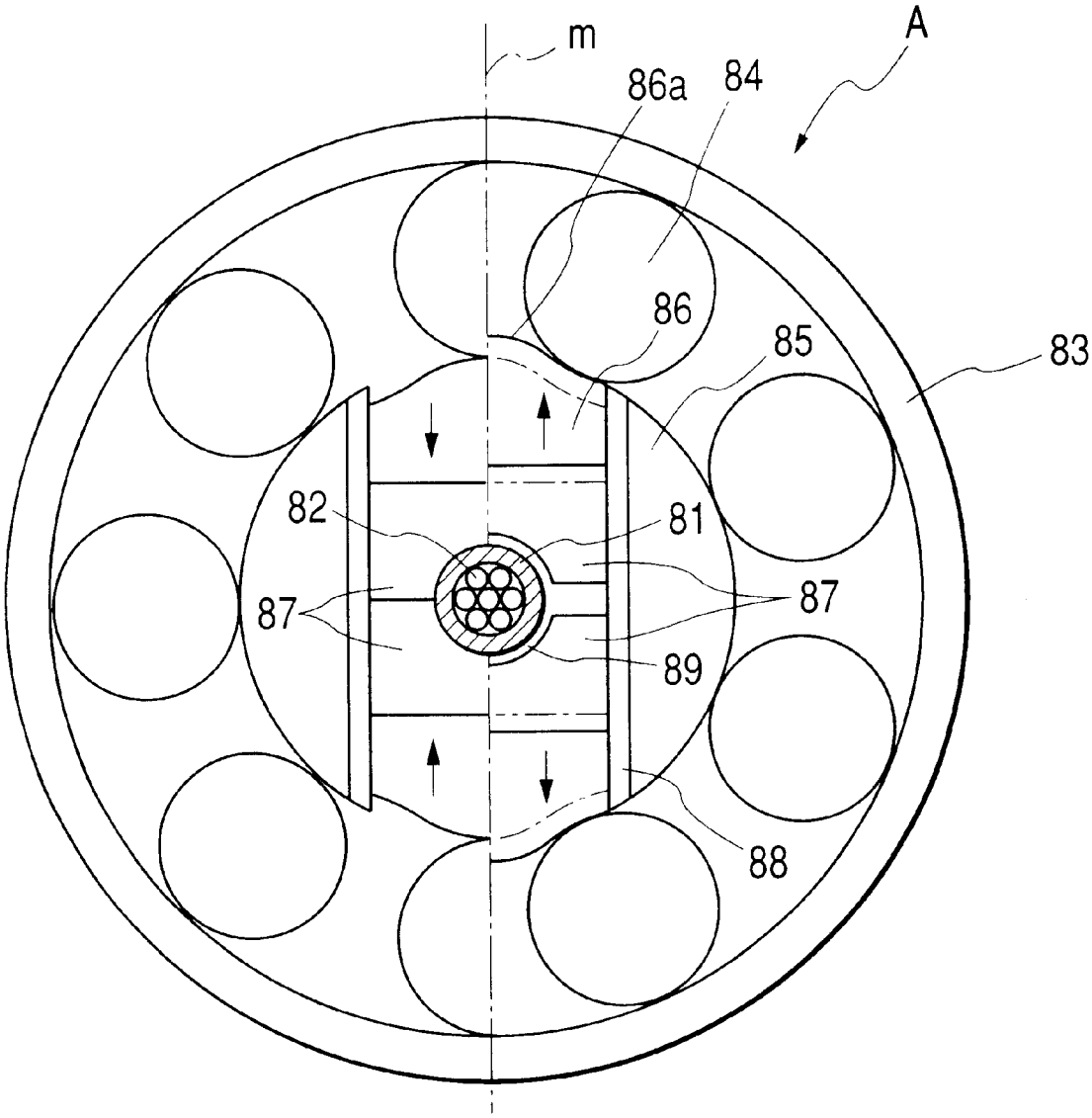
FIG. 18 is a front view (an explanatory view) showing another mode of a processing part of rotary swaging device for use with a connecting method according to the present invention for connecting a terminal with an electric wire.

FIG. 18 is a schematic diagram showing a mode of a processing part A of a rotary swaging device, in which reference numeral 81 denoted a cylindrical wire connecting portion of a terminal, reference numeral 82 a core wire portion of an electric wire, reference numeral 83 a ring, reference numeral 84 a roller, reference numeral 85 a spindle, reference numeral 86 a bucker (a hammer), reference numeral 87 die halves, and reference numeral 88 a side liner. Left half and right half portions of FIG. 18 which are divided by a center line m show a non-compressed state (the die halves 87 is opened) and a compressed state (the die is closed), respectively.

The spindle 85 is rotated by a motor, not shown. The die 87 is disposed such that a pair of die halves 87 become symmetrical and freely move in radial directions of the electric wire along the side liners 88. A semi-circular hole portion 89 is formed in the center of each die half 87 for insertion of the wire connecting portion 81 of a terminal. Each die half 87 is fixed to the bucker 86 disposed outwardly of the die half 87, and the bucker 86 freely moves in the radial directions of the electric wire together with the die half 87. An outer circumferential surface of the bucker 86 is formed into a cam surface 86*a*. The die halves 87 and the buckers 86 rotate together with the spindle 85. The cam surface 86*a* of the bucker 86 comes to contact the outer circumference of the rollers 84 disposed outwardly thereof. The plurality of rollers 84 are disposed between the spindle and the ring 83 at equal intervals and rotatably contact the cam surfaces 86*a* or the outer circumferential surface of the spindle 85 and the inner circumferential surface of the ring 83.

When the spindle 85 is driven to rotate by the motor (not shown), the die halves 87 and the buckers 86 rotate together with the cam surfaces 86*a* of the buckers 86 contacting the outer circumferences of the rollers 84 in such a manner that when top portions of the cam surfaces 86*a* come into contact with the rollers 84 the pair of die halves 87 are closed, while when the buckers 86 and the die halves 87 are forced to move outwardly by virtue of centrifugal force so that foot portions of the cam surfaces 86*a* come into contact with the rollers 84 the pair of die halves 87 are opened.

When the die halves 87 are closed, as shown in the left half portion of FIG. 18, the wire connecting portion 81 of the terminal is struck by the inner circumferential surfaces of the semi-circular hole portions 89 so as to be compressed in the radial direction, whereas when the die halves 87 are opened, as shown in the right half portion of FIG. 18, a gap is produced between the inner surfaces of the semi-circular hole portions 89 in the die halves 87 and the outer circumferential surface of the wire connecting portion 81 of the terminal. The terminal and the electric wire rotate to some extent in the same direction as a direction in which the die 87 rotates in association of rotation of the die 87. The core wire portion 82 of the electric wire is crimped into a substantially true circular shape through repeated rotational and opening and closing operations of the die 87.

Figure 1:
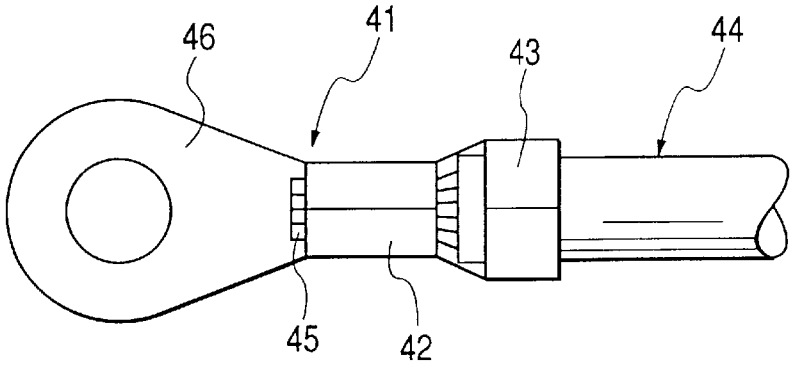
FIG. 1 PRIOR ART
FIG. 1 is a plan view showing a related structure for connecting a terminal and an electric wire.
Figure 2:
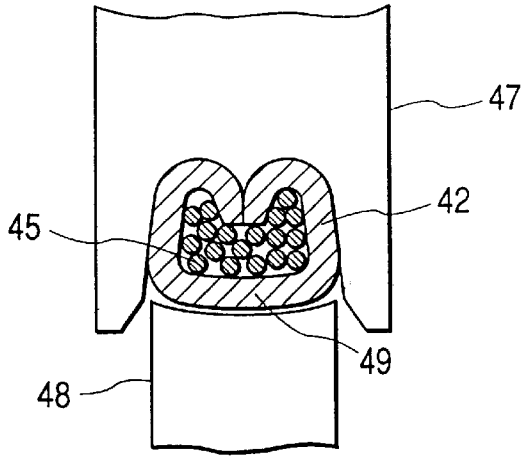
FIG. 2 PRIOR ART
FIG. 2 is a cross-sectional view for explaining a related method for connecting a terminal and an electric wire.
Figure 3:
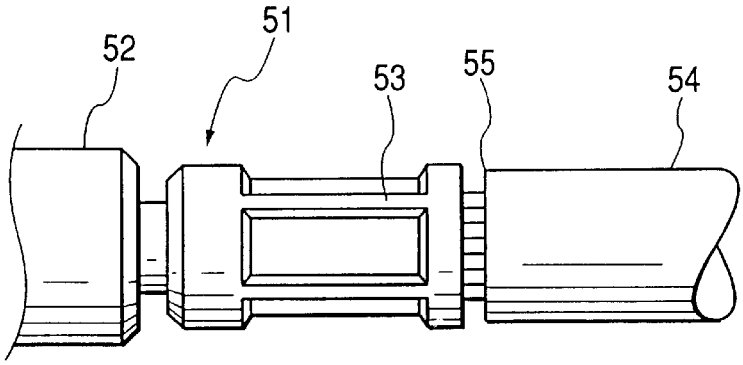
FIG. 3 PRIOR ART
FIG. 3 is a plan view showing another related structure for connecting a terminal and an electric wire.
Figure 4:
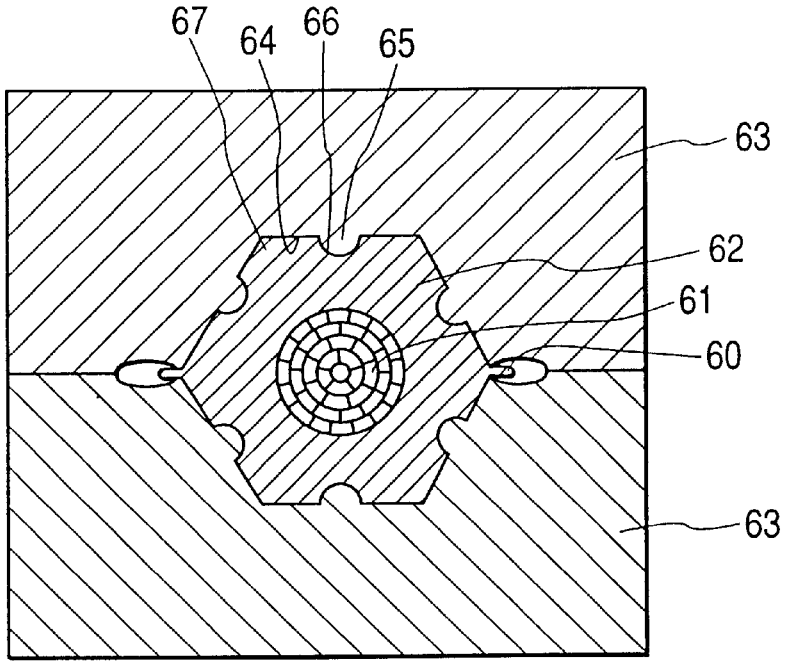
FIG. 4 PRIOR ART
FIG. 4 is a cross-sectional view for explaining another related method for connecting a terminal and an electric wire.
Figure 5:
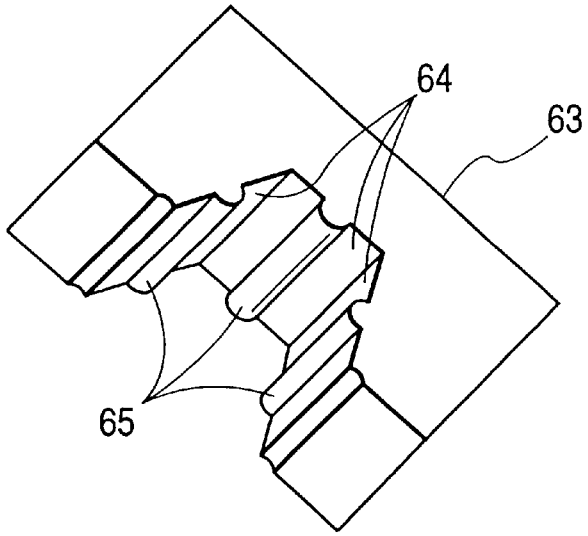
FIG. 5 PRIOR ART
FIG. 5 is a perspective view showing a crimping die.
Figure 6:
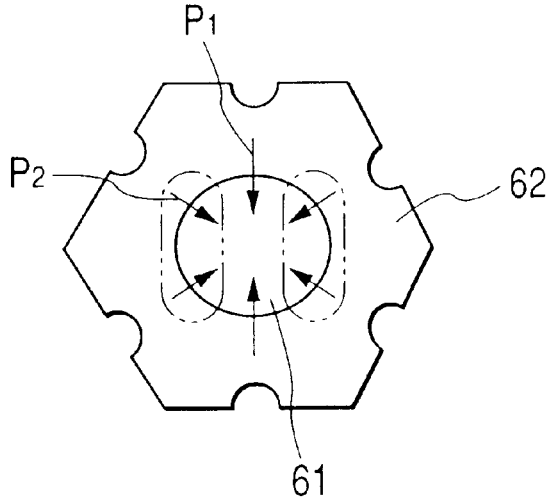
FIG. 6 is an explanatory view for explaining a problem with the related connecting method in the form of a difference in internal stresses P1, P2.
Figure 7:
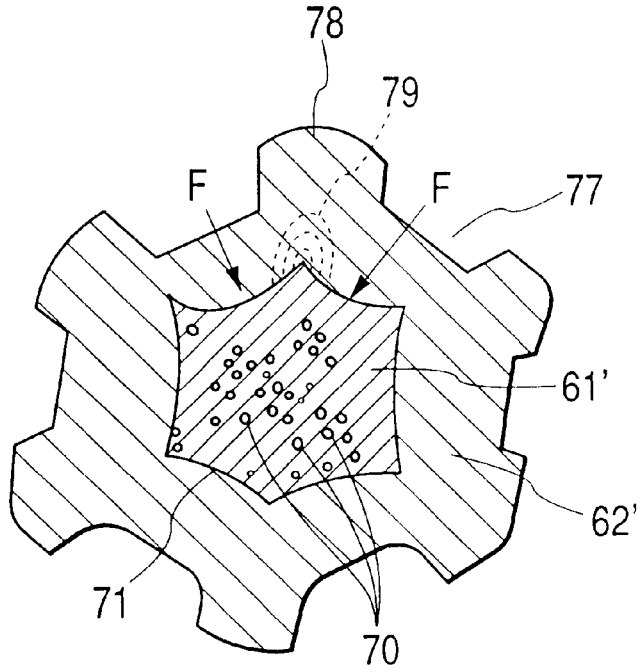
FIG. 7 PRIOR ART
FIG. 7 is a cross-sectional view showing the other structure for connecting a terminal and an electric wire.

Since the wire connecting portion 81 is compressed in the radial direction while the die 87 is rotated relative to the terminal, there is caused no risk of burrs being produced at the wire connecting portion 81 as with the case shown in FIG. 4, and the outer circumferential surface of the electric wire is imparted a good external appearance. At the same time the wire connecting portion 81 is crimped in a circumferential direction with a uniform force, whereby internal stresses of the core wire portion 82 and the wire connecting portion 81 become uniform, thereby preventing gaps from being produced between respective strands of the core wire portion 82 and between the core wire portion 82 and the wire connecting portion 81.

Figure 19A:
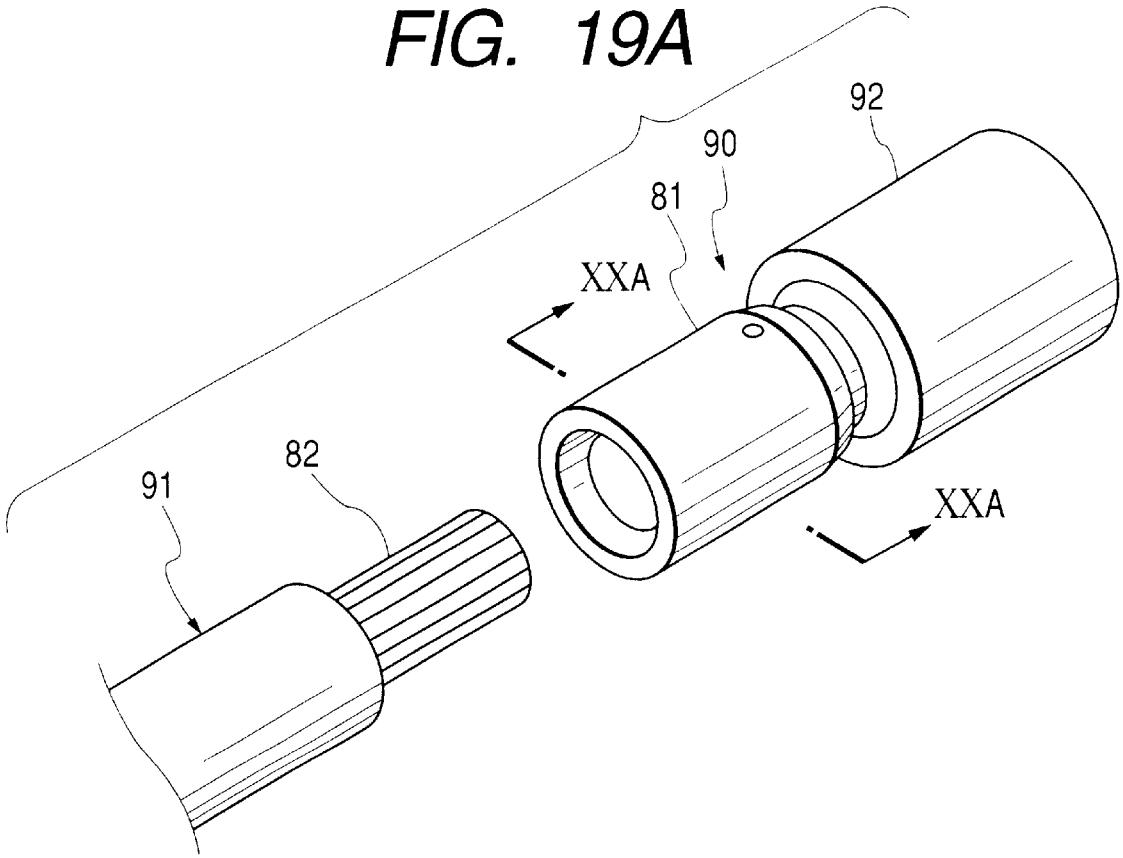
FIGS. 19A and 19B are perspective views showing states of the terminal and electric wire before (i.e., FIG. 19A) and after (i.e., FIG. 19B) a connection is implemented.
Figure 19B:
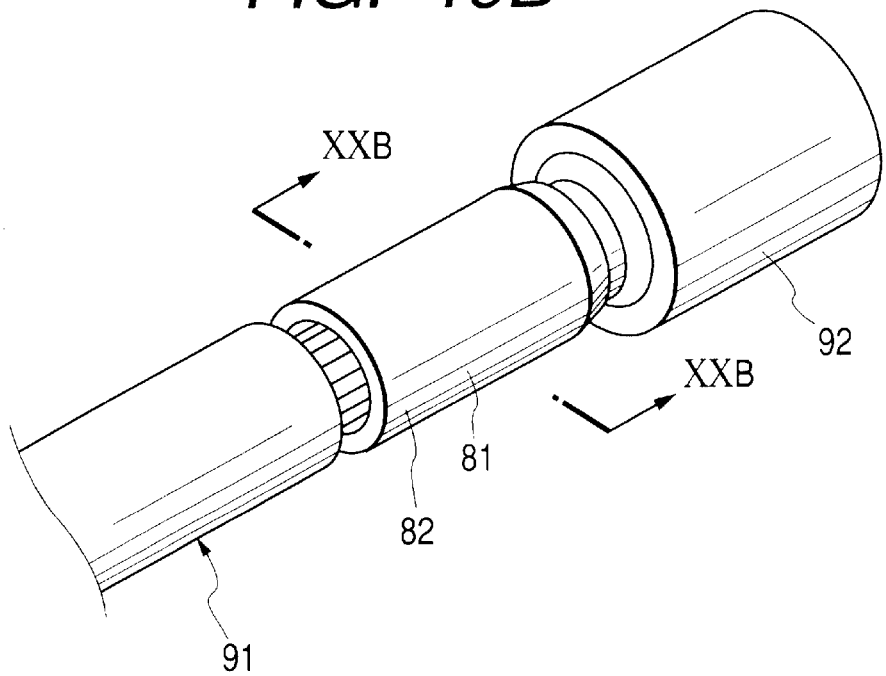

FIGS. 19A and 19B show modes before and after a terminal 90 is crimped around an electric wire 91 for connection, respectively. As shown in FIG. 19A, using the terminal 90 having a cylindrical mating terminal connecting portion 92 at one end and the cylindrical wire connecting portion 81 at the other end thereof, the core wire portion 82 of the electric wire 91 is inserted into the wire connecting portion 81 of the terminal 90. The wire connecting portion 81 of the terminal 90 is then crimped in the radial direction while the die 87 is rotated by the swaging device shown in FIG. 18, as shown in FIG. 19B so that the electric wire 91 is connected uniformly. The wire connecting portion 81 extends longitudinally and contracts radially. The compressed portion of the wire connecting portion formed into a true circular shape in cross section.

Figure 20A:
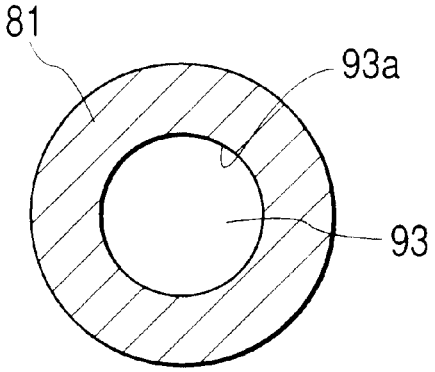
FIGS. 20A and 20B are cross-sectional views taken along the XXA—XXA in FIG. 19A and the line XXB—XXB in FIG. 19B.
Figure 20B:
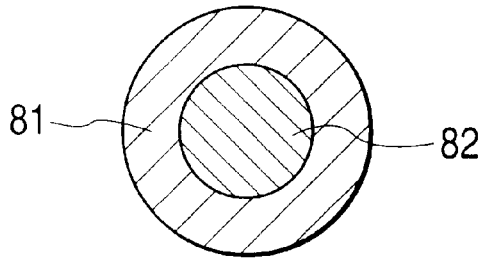

FIGS. 20A and 20B show cross-sectional shapes of the wire connecting portion before and after the terminal 90 is crimped around the electric wire, respectively. The diameter of the wire connecting portion 81 which is shown as being large in FIG. 20A is reduced slightly through swaging, and the core wire portion 82 of the electric wire 91 uniformly adheres to the inner circumferential surface 93*a* of a hole portion 93 in the wire connecting portion 81 in such a manner as to produce no gaps therebetween. There is produced no gap between the respective strands in the core wire portion 82, either.

Figure 21:
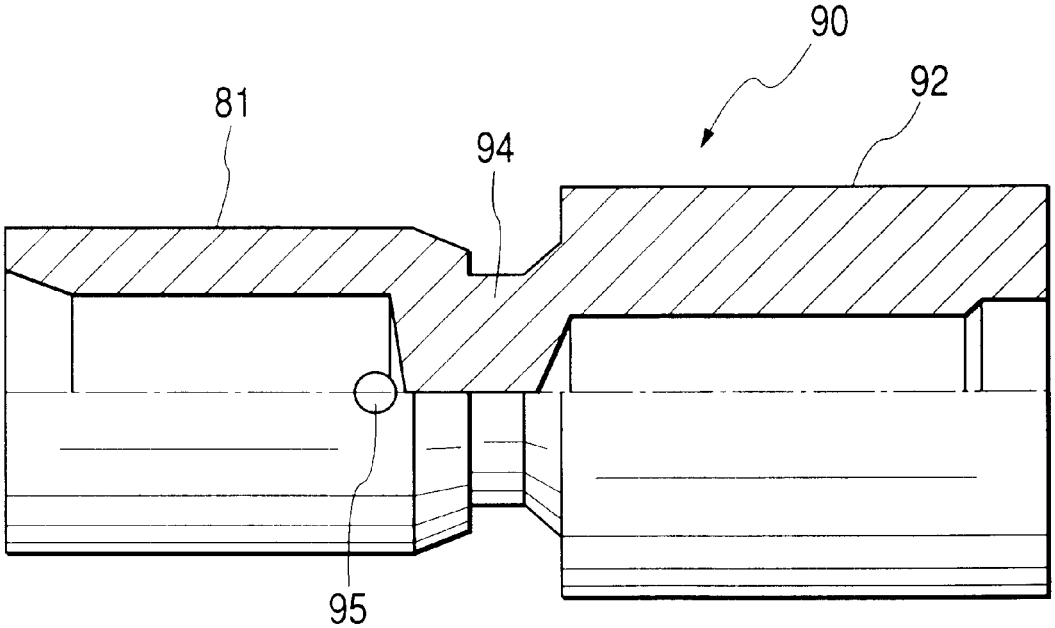
FIG. 21 is a half cross-sectional view of the terminal (a cross section is shown on one of half views divided by the center line, whereas the external appearance of the terminal is shown on the other half view)

FIG. 21 is a half cross-sectional view showing a mode of the terminal 90 in detail. The mating terminal connecting portion formed at the one end of the terminal 90 is formed thick, whereas the wire connecting portion formed at the other end thereof is formed half the thickness of the mating terminal connecting portion 92. The inside diameter of the wire connecting portion 81 is made larger than the inside diameter of the mating terminal connecting portion 92. The wire connecting portion 81 is crimped circumferentially smoothly with reasonable uniform force by crimping the cylindrical wire connecting portion 81 in the radial direction by rotating the die 87 (see FIG. 18) circumferentially relative to the wire connecting portion 81 through swaging and this can make the wire connecting portion thinner. The thin wire connecting portion 81 can increase the adherence between the wire connecting portion 81 and the core wire portion 82 of the electric wire (FIGS. 19A and 19B).

The wire connecting portion 81 is made slightly shorter than the mating terminal connecting portion 92. Both the connecting portions are formed into a cylindrical shape and are connected to each other via a partition wall 94 of a small diameter. A small through hole 95 for venting air is formed in a proximal portion of the wire connecting portion (on a partition wall 94 side) so that air inside the wire connecting portion 81 is discharged through the small hole 95 when swaging. A pin-like (a male type) terminal having, for example, a plurality of resilient contact pieces (not shown) around the circumference thereof is inserted into the mating terminal connecting portion 92 for connection. The terminal 90 is a female type terminal.

The inside diameter and thickness of the wire connecting portion 81 of the terminal 90 can be set variously according to the outside diameter of the core wire portion 82 of the electric wire 91 through swaging, and the electric wire 91 is not limited to a thick electric wire but may be a thin one. A thin electric wire that is connected to an existing solderless or crimp terminal (not shown) can also be connected to a terminal (10) of the same type as that shown in FIG. 21.

The terminal shown in FIG. 21 can easily be formed through, for example, forging or shaping. Note that the mating terminal connecting portion formed at the one end of the terminal shown in FIG. 21 can be formed into a tab-like shape.

Figure 22:
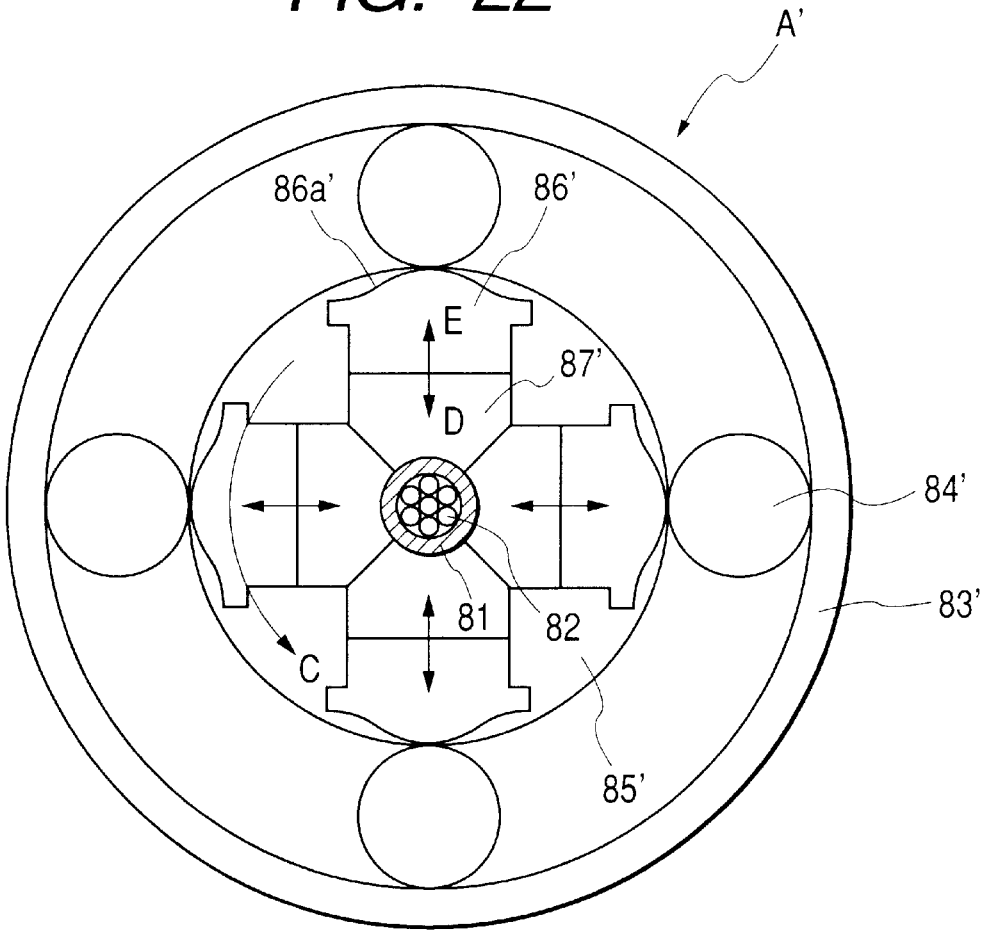
FIG. 22 is a front view (an explanatory view) showing the other mode of a processing part of a rotary swaging device.

FIG. 22 is a schematic diagram showing the other mode of a processing part A' of the rotary swaging device, in which reference numeral 81 denotes a cylindrical wire connecting portion of a terminal, reference numeral 82 a core wire portion, reference numeral 83' a ring, reference numeral 84' a roller, reference numeral 85' a spindle, reference numeral 86' a bucker (a hammer), and reference numeral 87' a die. In this processing part A' of the processing device, there are provided four die pieces 87' and four buckers 86' which are disposed at 90 degrees intervals. When compared to the processing part A of the processing device in FIG. 18, the number of die pieces 87' provided thereat is larger, whereby the wire connecting portion 81 of a terminal is struck and crimped efficiently at small intervals with the four die pieces 87', whereby the crimping operation is implemented more uniformly and internal stress directed inwardly of the wire connecting portion 81 acts on the core wire portion 82 of the electric wire more uniformly.

When the spindle 85' rotates by driving a motor, not shown in FIG. 22, the die pieces 87' and the buckers 86' rotate together in a direction indicated by an arrow C in such a manner that when angled cam surfaces 86*a*' of the buckers 86' come into contact with the rollers 84' the die pieces 87' are closed inwardly as indicated by arrows D so as to strike (compress) the wire connecting portion 81 of the electric wire in radial directions, whereas when foot portions of the cam surfaces 86*a*' come into contact with the rollers 84' the die pieces 87' are opened outwardly as indicated by arrows E by virtue of centrifugal force. These operations are repeated at shorter intervals (half the interval shown in FIG. 18).

Figure 23:
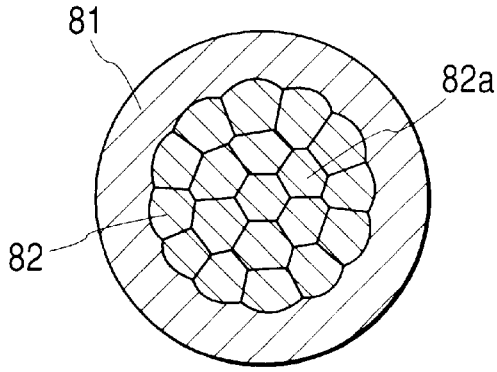
FIG. 23 is a cross-sectional view showing a connecting portion of the terminal and the electric wire after the crimping operation has been implemented.
Figure 24:
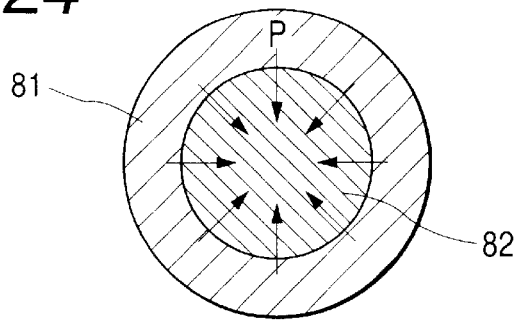
FIG. 24 is an explanatory view showing internal stress in arrows P in the connecting portion after the crimping operation shown in FIG. 23.

FIG. 23 is a cross sectional view showing a state in which the core wire portion 82 of the electric wire is crimped and connected to each other in the wire connecting portion of the terminal, and as shown in FIG. 24, internal stress (crimping force) acts uniformly from respective portions around the circumference of the cylindrical wire connecting portion 81 toward the center of the core wire portion 82 of the electric wire, applying uniform crimping force P to the core wire portion 82. Thus, respective strands 82*a* (see FIG. 23) of the core wire portion 82 are formed substantially into a honeycomb-like shape (a hexagonal shape), and no gap is produced between the respective strands 82*a*. In addition, since the core wire portion 82 and the wire connecting portion 81 is caused to uniformly adhere to each other in the circumferential direction, there is caused no risk of gap being produced therebetween.

The aforesaid rotary swage process is a mode of connecting methods, and the method for pressurizing the terminal (see FIG. 21) and the electric wire 91 from around the full circumference thereof to deform them plastically for connection may be implemented using other methods. The hexagonal crimping as shown in FIG. 4 cannot be referred to as plastic deformation of the terminal and electric wire from around the full circumference thereof but to as plastic deformation from six directions, and the plastic deformation of the cylindrical wire connecting portion 81 of the terminal from around the full circumference means deforming plastically uniformly the full circumference of the cylindrical wire connecting portion in every nook and corner.

The core wire portion 82 of the electric wire 91 is uniformly deformed as deep as the center thereof through pressurizing it from around the full circumference thereof for connection, and since no gap is produced between the respective strands 82*a* and between the core wire portion 82 and the wire connecting portion 81, the contact area is increased to obtain stable low electric resistance.

In general, in a case where the joining surface, that is, the inner circumferential surface of the wire connecting portion includes a completely clean metallic surface and the electric properties of the contact portion, that is, the wire connecting portion 81 are identical to those of the base material, that is, the terminal 90, a lumped resistance Rc is expressed by the following equation:

$$Rc=Pm/2a$$

(where, Pm is the specific resistance of the base material, and a is a radius of the true contact area).

It is seen from this equation that with the same contact pressure being applied to the contact surface, in case a wider true contact area is obtained, the lumped resistance Rc at the connecting portion becomes smaller. Due to this the wider the contact area becomes, the smaller the electric resistance becomes.

Looking at a photograph (not shown) showing the cross section of the actual connecting portion shown in FIGS. 23 and 24, no gap exists between the core wire portion 82 and the wire connecting portion 81 and between the respective strands 82*a* by pressurizing the terminal and the electric wire from around the full circumference thereof to plastically deform them for connection, and the terminal and electric wire are plastically deformed as deep as the center of the core wire portion 82, an ideal connected state in which electric resistance low being thereby obtained.

Figure 25:
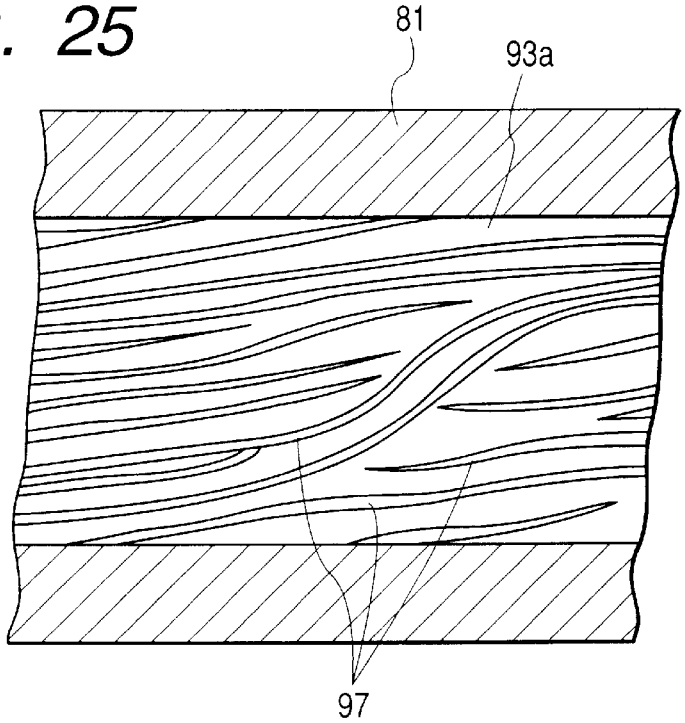
FIG. 25 is a cross-sectional view showing the internal surface of the wire connecting portion of the terminal disassembled after the crimping operation has been implemented.

FIG. 25 shows a state of the inner circumferential surface of the hole portion 93 in the wire connecting portion 81 resulting when the wire connecting portion is cut and the core wire portion 82 is removed after the wire connecting portion 81 of the terminal is crimped around the core wire portion 82 of the electric wire 91 for connection, and an infinite number of grooves 97 are formed over the full circumference thereof as marks of the respective strands which bit into the inner circumferential surface of the wire connecting portion 81. It is seen from this how strongly and uniformly the respective strands 82*a* adhere to the wire connecting portion 81. Since the respective strands 82*a* are inclined in a direction in which they are twisted, the grooves 97 are formed in an inclined fashion.

Figure 26:
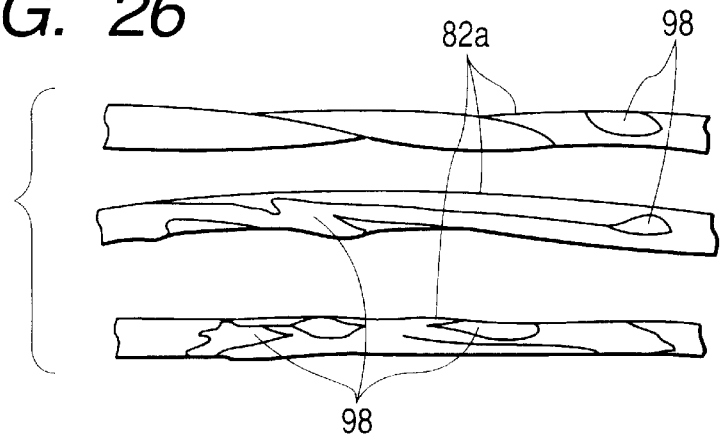
FIG. 26 is a plan view showing surface conditions of respective strands of the electric wire disassembled after the crimping operation has been implemented.

FIG. 26 shows a state of the surface of the respective strands 82*a* after the crimping operation has been implemented (what results from tracing a photo), an infinite number of dents 98 are formed in the surface of the respective strands 82*a* as marks of the strands 82*a* which bit into each other. It is seen from this how strongly and uniformly the respective strands were compressed in the radial directions. The states shown in FIGS. 25 and 26 prove that a highly reliable electric connection is established between the terminal 90 and the electric wire 91.

As has been described heretofore, according to the fourth embodiment of the present invention, the wire connecting portion of the terminal is uniformly compressed around the full circumference thereof in the radial directions of the electric wire, whereby the risk that burrs are produced between the die halves (burrs are produced because the die halves are not uniformly compressed around the full circumference thereof as shown in FIG. 4) can be eliminated. In addition, since the uniform internal stress acts on the full circumference of the wire connecting portion of the terminal and the core portion of the electric wire which is crimped within the wire connecting portion, in other words, since uniform outward internal stress acts on the core portion of the electric wire, thereby eliminating the concentration of stress that may occur at the crimping pat of the swaging device, not only are the wire connecting portion and the core wire portion caused to adhere strongly to each other without any gap being produced therebetween but also the respective strands of the core wire portion are also caused to adhere strongly to each other without any gap being produced therebetween, ensuring that low resistant connection is attained. Thus, this increases the reliability in establishing an electric connection between the terminal and the electric wire.

In addition, according to the fourth embodiment of the present invention, the wire connecting portion of the terminal can be uniformly compressed around the full circumference thereof in the radial directions of the electric wire in a more assured fashion by compressing the wire connecting portion around the full circumference thereof in the radial directions of the electric wire, whereby the advantages provided according to the first and third aspects of the present invention is exhibited in a more assured fashion.

A fifth embodiment of the present invention now will be described with reference to FIGS. 27 to 30. FIGS. 27 to 30 show the other structure for connecting a terminal with an electric wire according to the present invention.

Figure 27:
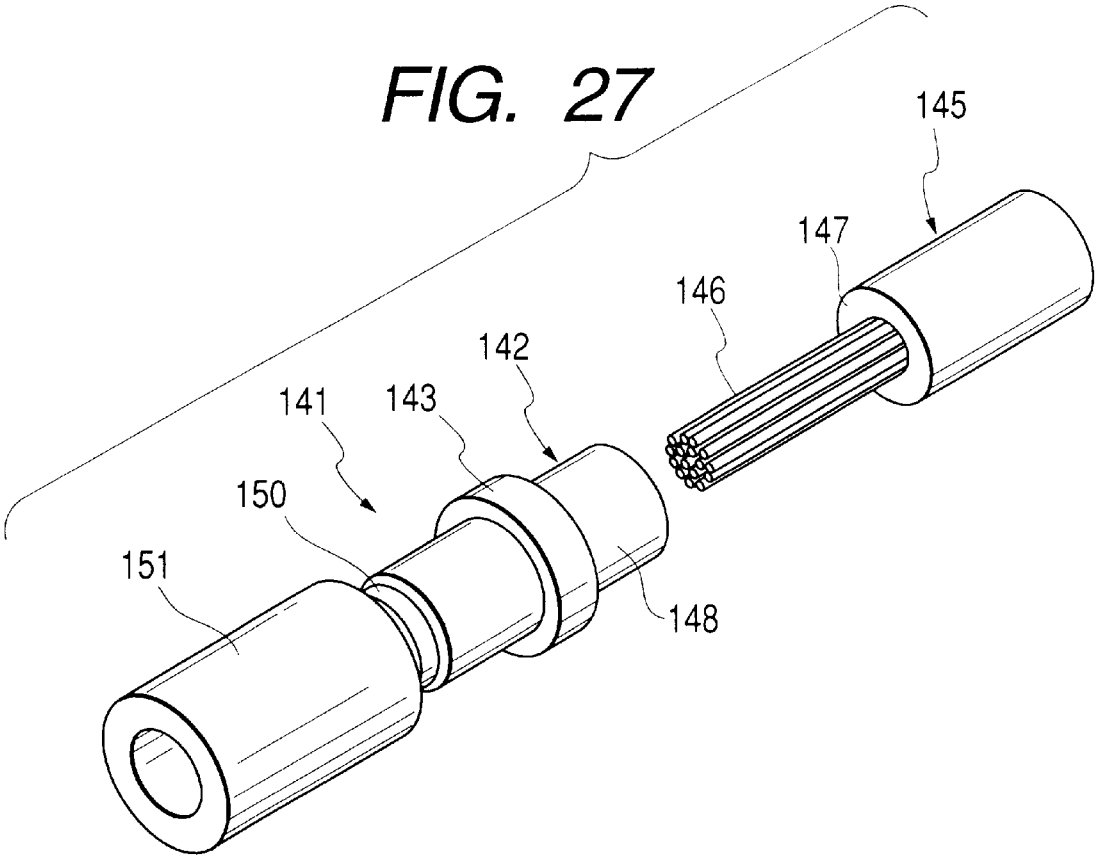
FIG. 27 is an exploded perspective view showing a structure for connecting a terminal with an electric wire according to a fifth embodiment of the present invention in a state before connecting the terminal with the electric wire.
Figure 28:
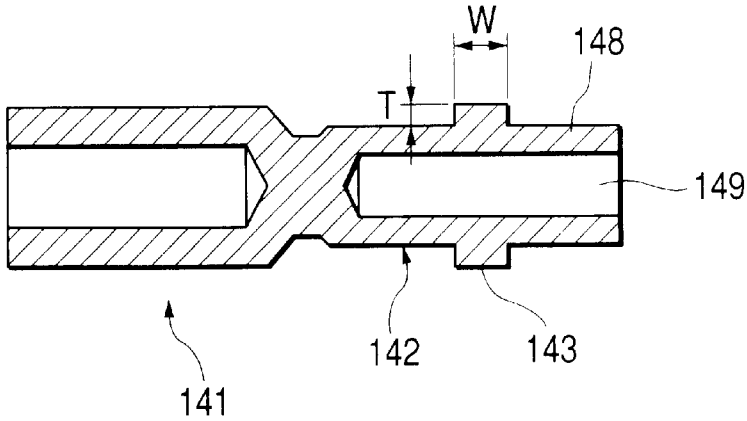
FIG. 28 is a longitudinal cross-sectional view showing the terminal of FIG. 27.
Figure 29:
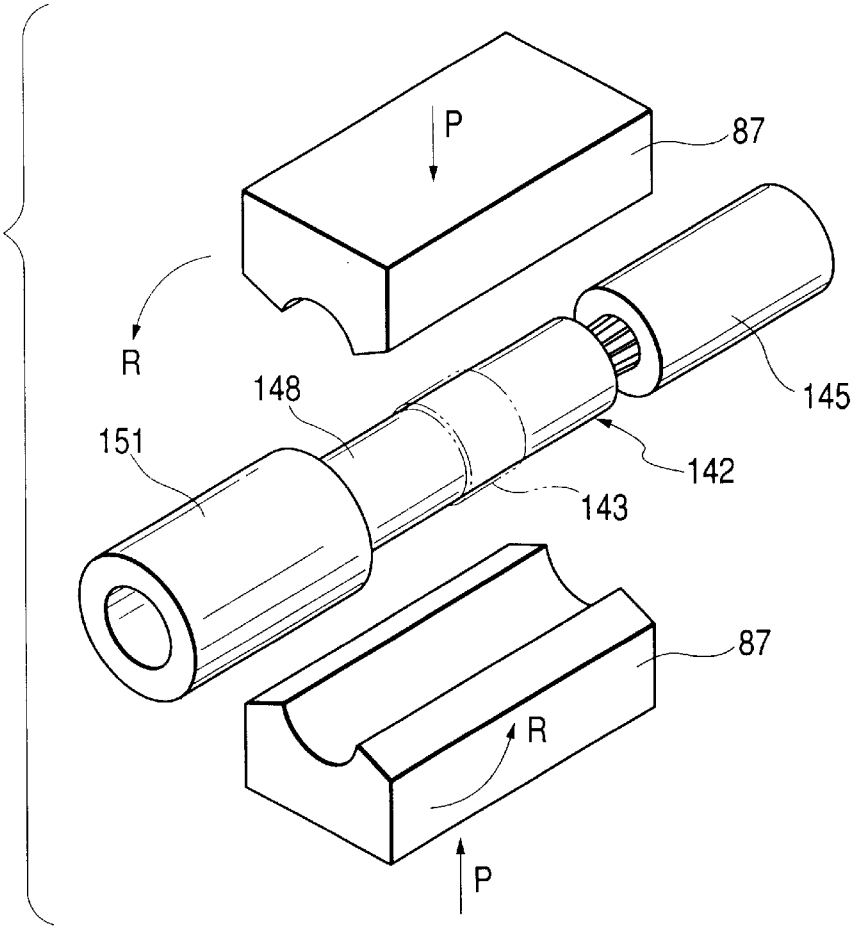
FIG. 29 is a perspective view for explaining a method for connecting the terminal using the connecting structure of FIG. 27 with the electric wire (in a state of a middle processing)
Figure 30:
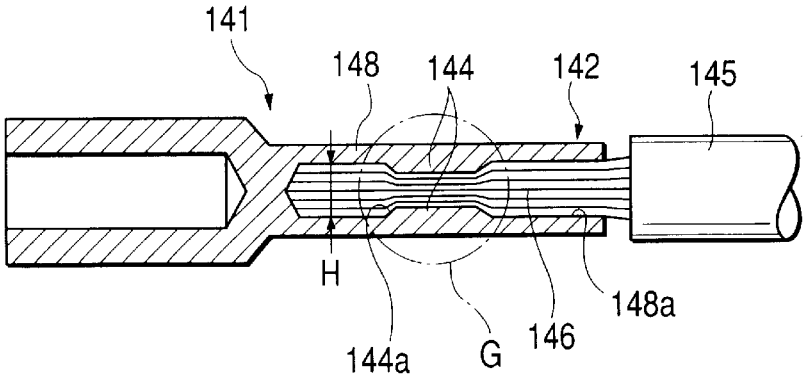
FIG. 30 is a longitudinal cross-sectional view of the structure, showing a state after the connection has been made.

In the method and structure for connecting a terminal with an electric wire, as shown in FIGS. 27 and 28, a circumferentially elongated projection (a projecting portion) 143 is annularly integrally formed around the outer circumferential surface of the wire connecting portion 142. As shown in FIGS. 29 and 30, a portion of the wire connecting portion 142 is caused to project annularly inwardly from the inner circumferential surface of the wire connecting portion 142 by a volume corresponding to the circumferentially elongated projection 143 when the wire connecting portion 142 is radially uniformly struck around the full circumference thereof with a plurality of die halves 87 of a rotary swaging device so as to compressively deform the wire connecting portion 142, so that the portion that is caused to project inwardly is allowed to bite into the core wire portion 146 of the electric wire 145 in an annular fashion to thereby provide a strong and secure contact therebetween by virtue of wedge effect.

In FIG. 27, the circumferentially elongated projection 143 is disposed on a longitudinal central portion of a cylindrical circumferential wall 148 of the wire connecting portion 142. As shown in FIG. 28, the wire connecting portion 142 has a circular cross section in which a wire insertion hole 149 is formed. Preferably, the circumferentially elongated projection 143 is located at a central portion in a longitudinal direction of the wire insertion hole 149.

As an example, the circumferentially elongated projection 143 may have a rectangular cross section as shown in FIG. 28. Further, the thickness T of the circumferentially elongated projection 143 may be set substantially equal to or thinner than the thickness of the circumferential wall 148. Also the width W of the circumferentially elongated projection 143 may be set substantially one fifth of the length of the wire connecting portion 142. The circumferentially elongated portion 143 may be formed to have a trapezoidal or triangular cross section. As an example, the circumferentially elongated projection 143 may be annularly cut and formed at the same time the wire connecting portion 142 is cut. Alternatively, the circumferentially elongated projection 143 may be formed at the same time the wire connecting portion 142 is rolled. In addition, the circumferentially elongated projection 143 may be formed as a separate ring member (not shown) and a rotary swaging process may be performed in a state in which the ring member is fittingly attached to the outer circumference of the cylindrical circumferential wall 148, so that the cylindrical circumferential wall 148 is radially inwardly compressed.

In FIGS. 27 and 28, the wire connecting portion 142 coaxially continues to a mating terminal connecting portion 151 via a smaller-diameter-partition wall portion 150. The mating terminal connecting portion 151 and the partition wall portion 150 are similar to those of the previous embodiment shown in FIGS. 19A, 19B and 21, and therefore the description thereof will be omitted here. Furthermore, the wire connecting portion 142 is almost similar to that in the previous embodiment shown in FIGS. 18 to 25, except for the circumferentially elongated projection 143. The electric wire 145 is also the same as that in the previous embodiment and an insulating coating 147 on a distal end portion of the electric wire 145 is stripped off to expose the core wire portion 146 that is a conductor.

With the core wire portion 146 of the electric wire 145 being inserted into the wire connecting portion 142 of the terminal 141, the wire connecting portion 142 is set between the plurality of die halves 87 at the processing portion of the rotary swaging device. When the swaging device is actuated such that the plurality of die halves 87 reciprocate in radial directions of the electric wire 145 as indicated by arrows P to repeatedly strike the wire connecting portion 142 while rotating in a circumferential direction of the electric wire 145 as indicated by arrows R, whereby the wire connecting portion 142 is longitudinally prolonged while being uniformly compressed around the full circumference thereof.

In the above process, the circumferentially elongated projection 143 starts to be compressed earlier than the circumferential wall 148 of the wire connecting portion 142 and is gradually forced into the circumferential wall 148, whereby the inner circumferential surface 148*a* of the circumferential wall 148 annularly protrudes into the wire insertion hole 149 (see FIG. 28), as shown in FIG. 30. As is shown in FIG. 29, the circumferentially elongated projection 143 is compressed to level with the outer circumferential surface of the circumferential wall 148, and as has been described above, is prolonged in the axial direction of the electric wire 145 together with the circumferential wall 148 (integrally therewith) while being compressed in the radial directions of the electric wire 145.

Then, as indicated by reference numeral G in FIG. 30, the circumferentially elongated projection 143 (see FIG. 29) is finally caused to annularly project from the inner circumferential surface 148*a* of the circumferential wall 148, and the inside diameter of this projecting portion 144 becomes smaller than the outside diameter H of the core wire portion 146 at the compressed electric wire 145. Thus, the projecting portion 144 bites into the core wire portion 146 and the retaining force (the mechanical strength) of the electric wire 145 is improved by virtue of wedge effect. The projection portion 144 also strongly compress the core wire portion 146 around the full circumference thereof and comes into strong close contact to the core wire portion 146, thereby improving the reliability in establishing an electric connection therebetween. Even if a strong drawing force is applied to the electric wire 145, the improvement in retaining force ensures that the dislocation of the core wire portion 146 from the wire connecting portion 142 is prevented.

In FIG. 30, the outside diameter of the portion of the wire connecting portion 142 where the circumferentially elongated projection 143 is disposed becomes equal to the outside diameter of the circumferential wall 148, and the protrusion resulting due to the circumferentially elongated projection 143 is thus eliminated and the outer circumference of the wire connecting portion 142 becomes a smooth arc-like surface. In addition, longitudinal ends 144*a* of the projecting portion 144 are formed in a tapered fashion, and the smooth contact of these tapered portions with the core wire portion 146 prevents strands on the outer circumferential side of the core wire portion 146 from being cut.

In addition, since there exists no protrusion on the inner circumferential surface of the wire insertion hole 149 inside the wire connecting portion 142 in the state in which no swaging process is started as shown in FIG. 28, the core wire portion 146 of the electric wire 145 (see FIG. 27) can be inserted into the wire insertion hole 149 smoothly and assuredly without any disruption.

Note that while the circumferentially elongated projection 143 is formed annularly with the same width around the circumference thereof, if no problem with forming, the width W of the elongated projection 143 may be varied in a wave-like or rectangular wave-like fashion, or the thickness thereof may also be varied. The number of circumferentially elongated projection 143 is not limited to one but may be increased to two or greater.

In addition, while the circumferentially elongated projection 143 is used in this embodiment, the present invention is not limited to such the projection, and, for example, the annular circumferentially elongated projection 143 may be partially broken at portions around the circumference thereof so as to produce a plurality of projections (i.e., projecting portions), not shown, which are disposed at regular intervals. The configuration of the projections may be set variously including rectangular, short cylindrical, and pyramidal configurations. The number of projections maybe one, but it is preferable to provide two projections in a 180-degree direction (or an opposite direction) or more projections at regular intervals. The individual locations of the projections should not be limited to an annular line, the projections may be arranged in parallel or in a zigzag manner in a longitudinal direction of the wire connecting portion 142.

Instead of the circumferentially elongated projection 143, an elongated projection may be formed on the wire connecting portion 142 along a longitudinal direction thereof in a straight manner, not circumferentially formed. In this case, it is preferable to provide two projections in a 180-degree direction (or an opposite direction) or more projections at regular intervals.

Furthermore, the wire connecting portion 142 of the terminal 141 may be uniformly compressively deformed in radial directions around the full circumference thereof using any other method than the rotary swaging method. In such a case, too, the elongated projection 143 or projections are caused to project inwardly from the inner circumferential surface of the circumferential wall 148 so as to bite into the core wire portion 146 of the electric wire 145 with the full-circumferential crimping device. Should there still remain a slight projection on the outer circumferential surface of the circumferential wall 148 resulting from something like the imperfect compression the circumferentially elongated projection 143, this would cause no problem in practice.

As has been described heretofore, according to the fifth embodiment of the present invention, since the projection on the outer circumferential side is forced inwardly of the wire connecting portion due to the full circumferential crimping of the wire connecting portion to thereby be allowed to bite into the core wire portion of the electric wire, the fixing force of the electric wire to the terminal is increased by virtue of wedge effect, whereby not only is the core wire portion prevented from being dislocated from the terminal when the electric wire is pulled but also the contact pressure between the projection and the core wire portion is increased, the reliability in establishing an electric connection therebetween being thereby improved.

Moreover, the annular circumferentially elongated projection is allowed to project annularly to the inner circumferential side of the wire connecting portion, and the core wire portion of the electric wire is uniformly circumferentially crimped by this projecting portion, whereby the core wire portion is prevented from being dislocated from the wire connecting portion in an assured fashion. In a case where a plurality of projections is used instead of the annular circumferentially elongated projection, the core wire portion is uniformly smoothly crimped, for example, at a plurality of locations in the longitudinal direction, whereby any damage is prevented from being made to the core wire portion.

It is contemplated that numerous modifications may be made to the structure for connecting a terminal and an electric wire, and the method for connecting a terminal to an electric wire, of the present invention without departing from the spirit and scope of the invention as defined in the following claims.

What is claimed is:

1. A structure for connecting a terminal and an electric wire, comprising:

a tubular wire connecting portion, into which a core wire portion of an electric wire is inserted, formed on a terminal; and a plurality of irregularities formed on an internal circumferential surface of the wire connecting portion of the terminal, wherein the wire connecting portion is crimped around a full outer circumference thereof, such that in a longitudinal cross section, which is coincident with a longitudinal axis of the terminal, an entire length of the wire connecting portion in which the core wire portion is inserted has an outermost thickness that is uniform, whereby the irregularities bite into the core wire portion of the electric wire, wherein the irregularities include at least one spiral groove and a plurality of thread portions, wherein the core wire portion of the electric wire is twisted, and wherein a spiral direction of the irregularities is opposite to a twisting direction of the core wire portion of the electric wire.

2. A structure for connecting a terminal and an electric wire, comprising:

a tubular wire connecting portion, into which a core wire portion of an electric wire is inserted, formed on a terminal; and a plurality of irregularities formed on an internal circumferential surface of the wire connecting portion of the terminal, wherein the wire connecting portion is crimped around a full outer circumference thereof, such that in a longitudinal cross section, which is coincident with a longitudinal axis of the terminal, an entire length of the wire connecting portion in which the core wire portion is inserted has an outermost thickness that is uniform, whereby the irregularities bite into the core wire portion of the electric wire, wherein the irregularities include groove portions and thread portions, and wherein the groove portions and thread portions intersect with each other.

3. A method for connecting a terminal to an electric wire, comprising the steps of:

providing a terminal including a tubular wire connecting portion;

inserting a core wire portion of an electric wire into the wire connecting portion of the terminal;

crimping the wire connecting portion in a radial direction of the electric wire;

uniformly compressing the wire connecting portion around a full outer circumference thereof in the radial direction of the electric wire, such that in a longitudinal cross section, which is coincident with a longitudinal axis of the terminal, an entire length of the wire connecting portion in which the core wire portion is inserted has an outermost thickness that is uniform; and forming a projecting portion on an outer circumference of the wire connecting portion, wherein, in the uniformly compressing step, the projecting portion is pressed, thereby causing an inner surface of the wire connecting portion to partially inwardly project so as to bite into the core wire portion.

4. A method for connecting a terminal to an electric wire, comprising the steps of:

providing a terminal including a tubular wire connecting portion;

inserting a core wire portion of an electric wire into the wire connecting portion of the terminal;

crimping the wire connecting portion in a radial direction of the electric wire;

uniformly compressing the wire connecting portion around a full outer circumference thereof in the radial direction of the electric wire, such that in a longitudinal cross section, which is coincident with a longitudinal axis of the terminal, an entire length of the wire connecting portion in which the core wire portion is inserted has an outermost thickness that is uniform; and forming a projecting portion on an outer circumference of the wire connecting portion, wherein, in the uniformly compressing step, while a die is rotated using a rotary swaging device, the wire connecting portion of the terminal is compressed with the die, and wherein, in the uniformly compressing step, the projecting portion is pressed, thereby causing an inner surface of the wire connecting portion to partially inwardly project so as to bite into the core wire portion.

5. A structure for connecting a terminal to an electric wire, the structure comprising:

a tubular wire connecting portion formed on a terminal;

a core wire portion of an electric wire inserted into the tubular wire connecting portion, wherein the wire connecting portion is crimped in a radial direction of the electric wire, such that the wire connecting portion is uniformly compressed along a full outer circumference thereof in the radial direction of the electric wire, and such that in a longitudinal cross section, which is coincident with a longitudinal axis of the terminal, an entire length of the wire connecting portion in which the core wire portion is inserted has an outermost thickness that is uniform, whereby a circumference of a compressed portion of the wire connecting portion is formed into a round shape in cross section; and a projecting portion formed on an outer circumference of the wire connecting portion before the wire connecting portion is crimped, wherein the projecting portion is pressed when the wire connecting portion is uniformly compressed, thereby causing an inner surface of the wire connecting portion to partially inwardly project so as to bite into the core wire portion.

6. The structure of claim 5, wherein the projecting portion includes one of a circumferentially elongated projection and at least one projection.

* * * * *